US005436636A

United States Patent [19]

Nonoshita et al.

[11] Patent Number: 5,436,636

[45] Date of Patent: Jul. 25, 1995

[54] DISPLAY CONTROL DEVICE WHICH RESTRICTS THE START OF PARTIAL UPDATING IN ACCORDANCE WITH WHETHER THE NUMBER OF LINES TO BE UPDATED EXCEEDS A PREDETERMINED NUMBER

[75] Inventors: Hiroshi Nonoshita, Fujisawa; Yoshitsugu Yamanashi, Kawasaki; Kenzoh Ina, Yokohama, all of Japan

[73] Assignee: Canon Kabushiki Kaisha, Tokyo, Japan

[21] Appl. No.: 255,820

[22] Filed: Jun. 7, 1994

Related U.S. Application Data

[63] Continuation of Ser. No. 686,771, Apr. 17, 1991, abandoned.

[30] Foreign Application Priority Data

Apr. 20, 1990 [JP] Japan ..... 2-105630
Apr. 20, 1990 [JP] Japan ..... 2-105631
Apr. 20, 1990 [JP] Japan ..... 2-105632

[51] Int. Cl.[6] ..... G09G 3/36
[52] U.S. Cl. ..... 345/100; 345/98
[58] Field of Search ..... 340/721, 784, 798, 799, 340/800, 765, 811, 814; 359/56; 358/22 PIP, 136, 183; 345/87, 97, 98, 100

[56] References Cited

U.S. PATENT DOCUMENTS 4,581,611 4/1986 Yang et al. ..... 340/799
4,655,561 4/1987 Kanbe et al. ..... 359/56
4,693,563 9/1987 Harada et al. ..... 340/783
4,695,838 9/1987 Ellis, Jr. ..... 340/799
4,855,825 8/1989 Santamaki et al. ..... 358/136
4,922,241 5/1990 Inoue et al. ..... 340/784
4,952,032 8/1990 Inoue et al. ..... 350/350
4,962,376 10/1990 Inoue et al. ..... 340/784
4,964,699 10/1990 Inoue ..... 350/332
5,029,289 7/1991 Utsumi et al. ..... 340/814
5,091,723 2/1992 Kanno et al. ..... 340/811 X

FOREIGN PATENT DOCUMENTS 62-76357 4/1987 Japan .
63-243993 10/1988 Japan .
0368117 5/1990 United Kingdom ..... 340/784

*Primary Examiner*—Jeffery Brier
*Attorney, Agent, or Firm*—Fitzpatrick, Cella, Harper & Scinto

[57] ABSTRACT

A display control device for a display unit, using a ferroelectric liquid crystal or the like, capable of partially changing a display state of picture elements is provided with an entire updating means for updating a display of the entire picture surface of the display unit. A partial updating means is provided for updating only a portion in which display contents have changed during entire updating processing. A restriction means restricts the start of operation of the partial updating means in accordance with whether the number of lines to be updated exceeds a predetermined number, where the predetermined number is less than the total number of line in the display unit.

18 Claims, 34 Drawing Sheets

| |
|---|
| FIG. 2A |
| FIG. 2B |

| FLAG | SWA | SWB |
|---|---|---|
| 0 0 | LOWER THAN 5 °C | LOWER THAN 10 °C |
| 0 1 | EQUAL TO OR HIGHER THAN 5 °C, AND LOWER THAN 10 °C | EQUAL TO OR HIGHER THAN 10 °C, AND LOWER THAN 15 °C |
| 1 0 | EQUAL TO OR HIGHER THAN 10 °C, AND LOWER THAN 30 °C | EQUAL TO OR HIGHER THAN 15 °C, AND LOWER THAN 35 °C |
| 1 1 | EQUAL TO OR HIGHER THAN 30 °C | EQUAL TO OR HIGHER THAN 35 °C |

| |
|---|
| FIG. 13A |
| FIG. 13B |

ADDRESS COUNTER
38
ADDRESS CONVERSION TABLE
44
SYNCHRONIZATION CONTROL CIRCUIT
39
27
S3
ADDRESS SELECTOR
35
VIDEO MEMORY (DUAL PORT DRAM)
IMAGE DATA HEADER REGISTER
44A
36
S2
FIFO (A)
FIFO (B)
S1
37
SAMPLING COUNTER
34
MEMORY CONTROLLER
40
41
45
31
32
43
33
12

| |
|---|
| FIG. 20A |
| FIG. 20B |

FIG. 21

44

| ADDRESS | TABLE 1 | TABLE 2 | TABLE 3 | ---- | TABLE n |
|---|---|---|---|---|---|
| 0 | 900 | 14 | 32 | ---- | - - - - - - - - - - |
| 1 | 821 | 200 | 100 | ---- | |
| - - - - - - - - - - | 15 | - - - - - - - - - - | 59 | -- | |
| | - - - - - - - - - - | | - - - - - - - - - - | - - - - - - - - - - | |
| N - 1 | 8 | - | - | - | |
| N | 999 | 154 | 21 | ---- | |

DISPLAY CONTROL DEVICE WHICH RESTRICTS THE START OF PARTIAL UPDATING IN ACCORDANCE WITH WHETHER THE NUMBER OF LINES TO BE UPDATED EXCEEDS A PREDETERMINED NUMBER

This application is a continuation of application Ser. No. 07/686,771, filed Apr. 17, 1991, now abandoned.

BACKGROUND OF THE INVENTION

1. Field of the Invention

This invention relates to a display control device, and more particularly, to a display control device for a display unit having display elements which use, for example, a ferroelectric liquid crystal as an operating medium for updating display, and which can maintain a display state updated by the application of an electric field, or the like.

2. Description of the Related Art

In general, a display unit, serving as an information display means having a function of visually displaying information is connected to an information processing system or the like. CRTs (cathode-ray tubes) have been widely used as such display units. A display control device for a CRT connected to an information processing system is illustrated in FIG. 12.

In FIG. 12, an address bus driver 1, a control bus driver 2 and a data bus driver 3 are connected to system bus 4 for connecting respective units constituting an information processing system with signals. A video memory 5 stores display data transmitted via the data bus driver 3. A driver 6 transmits data from a display control device to a CRT 7.

The video memory 5 comprises a dual port DRAM (dynamic random access memory), in which display data are directly written. Display data written in the video memory 5 are sequentially read by a CRTC (CRT controller) 8, and are displayed on the CRT 7.

That is, in writing display data, a CPU (not shown) of the information processing system accesses an address of the video memory 5 corresponding to an display area on the CRT 7. First, a request signal for the access is supplied to a memory controller 9 via the control bus driver 2, where the signal is subjected to arbitration with a data transfer request signal or a refreshing request signal provided from the CRTC 8. In accordance with this operation, in the memory access by the CPU, an address selection signal is supplied from the memory controller 9 to an address selector 10, and an access address for data writing from the CPU is supplied to the video memory 5 via the address driver 1 and the address selector 10. In accordance with this operation, a DRAM control signal from the memory controller 9 and the display data via the data bus driver 3 are supplied to the video memory 5. The display data are thereby written in the video memory 5.

Display on the CRT 7 is executed in the following manner. That is, the CRTC 8 supplies the driver 6 with a synchronizing signal. In synchronization with the synchronizing signal, the CRTC 8 supplies the memory controller 9 with a data transfer request signal, and also supplies the address selector 10 with a data transfer address.

First, the data transfer request signal is subjected to arbitration by the memory controller 9. In accordance with this operation, an address selection signal is supplied from the memory controller 9 to the address selector 10. The data transfer address from the CRTC 8 is then supplied to the video memory 5 via the address selector 10. A DRAM control signal is supplied from the memory controller 9 to the video memory 5, and a data transfer cycle is thereby executed. The data transfer cycle indicates the transfer of data in units of a line (corresponding to a raster on the picture surface of the CRT 7) stored in the video memory 5 to a shift register within the video memory 5. Data from one line to several lines can be transferred to the shift register by one data transfer cycle.

The display data transferred to the shift register are sequentially read from the shift register by a serial port control signal supplied from the CRTC 8 to the video memory 5, and are output to and displayed on the CRT 7. The reading of the display data from the video memory 5 and the display of the read data are performed by a so-called entire-surface refreshing operation, wherein the reading and display are performed from the upper portion to the lower portion of a display area in units of a line, and from the left end to the right end on a line according to a predetermined order.

As described above, in the display control of the CRT 7, the writing operation of the CPU for the video memory 5 and the reading/displaying operation of display data from the video memory 5 by the CRT controller 8 are independently performed.

In the case of the above-described display control device for the CRT, since the writing operation of display data for the video memory 5 for changing display information and the like, and the reading/displaying operation of display data from the video memory B are independently performed, the device has the advantage that display timing and the like need not be considered in a program of the information processing system, and it is therefore possible to write desired display data with an arbitrary timing.

On the other hand, since the CRT particularly requires a certain length in the direction of the thickness of the display picture surface, its volume becomes large as a whole, and it is therefore difficult to make the entire display unit small. As a result, the freedom in the use of an information processing system using a CRT as a display unit, that is, the freedom in the place of installation, portability and the like is reduced.

In order to solve the above-described problems, a liquid crystal display (hereinafter termed an LCD) may be used. That is, by adopting an LCD, the entire display unit may be provided having a small size (particularly having a thin size). As one type of LCDs, there is a display unit using a ferroelectric liquid crystal (hereinafter termed an FLC) cell (hereinafter termed an FLCD). One of the features of the FLCD is that the FLC cell can maintain its display state after the application of an electric field. Hence, in driving the FLCD, there is an allowance in time for a period of continuously refreshing driving of the display picture surface, contrary to the CRT and other liquid crystal displays. Furthermore, independently of the continuous refreshing driving, it becomes possible to perform partial rewriting driving to update the display state of only a portion to be changed on the display picture surface. Accordingly, such an FLCD can provide a display unit having a larger picture surface than other liquid crystal displays.

The FLCD has a sufficiently thin liquid crystal cell. Molecules of slender FLCs within the cell are oriented in a first stable state or a second stable state in accordance with the direction of an applied electric field, and maintain their orientation state even after switching off the electric field. The FLCD has a storage capability due to such bistability of the FLC molecules. The details of such FLC and FLCD are described in, for example, Japanese Patent Application No. 62-76357 (1987).

However, when using the FLCD having the above-described advantages, as a display unit of an information processing system using the same display control as that of the CRT, the FLCD is in some cases incapable of following such a change in display information that a display must be instantaneously rewritten, for example, in the case of a cursor, a character input, scrolling and the like, since a time required for a display updating operation of the FLC is relatively long.

In a configuration utilizing the capability of partial rewriting which is one of the features of the FLCD, in order to perform the partial rewriting processing, for example, the information processing system side provides information for identifying the partial rewriting processing. In order to realize partial rewriting driving on the above-described display picture surface, however, a control program of the information processing system must be largely changed.

SUMMARY OF THE INVENTION

The present invention has been made in consideration of the above-described problems.

It is an object of the present invention to provide a display control device for an FLCD or the like having compatibility with a CRT without significantly changing software of an information processing system.

It is another object of the present invention to provide a display control device which can realize optimum picture quality by effectively utilizing the maintainability of a display state in an FLCD or the like.

These and other objects are accomplished, according to one aspect of the present invention, by a display control device for a display unit capable of partially changing a display state of picture elements, comprising updating means for entirely updating a display of the entire picture surface of the display unit. A partially updating means is provided for updating only a portion wherein display contents have changed during entirely updating processing, and restriction means for restricting the start of the partially updating means in accordance with a frequency of a command to update the portion.

According to another aspect, the present invention relates to a display control device for a display unit capable of partially changing a display state of picture elements, comprising switching means for alternately switching between a first time period for updating a display of the entire picture surface of the display unit and a second time period for updating only a portion wherein display contents have changed. A storage means stores the portion wherein display contents to be output during the second time period have changed. A means is provided for prohibiting the storage when an overlap of the portion wherein display contents have changed has been detected.

According to another aspect, the present invention relates to display control device for a display unit having a display picture surface, wherein a plurality of display elements capable of maintaining updated display states are arranged, for updating a display on the display picture surface according to display data. An address generation means is provided for generating addresses corresponding to the plurality of respective display elements in the order of arrangement of the plurality of display elements. An address conversion means having a plurality of conversion means provides addresses corresponding to other display elements which are different from display elements having addresses generated by the address generation means almost irregularly correspond to the generated addresses, and generates the addresses corresponding to the generated addresses in accordance with the generation of the addresses by the address generation means. A setting means sets the conversion means to be used for the generation of the addresses from among the plurality of conversion means which the address conversion means has in accordance with setting information and/or a temperature of the display picture surface, storage means for storing display data of the display elements corresponding to the plurality of respective display elements. A transfer means transfers display data corresponding to the display elements having the addresses generated by the conversion means set by the setting means from the storage means to the display means.

BRIEF DESCRIPTION OF THE DRAWINGS

FIG. 21 is a conceptual diagram of an address conversion table, shown in FIG. 20;

DETAILED DESCRIPTION OF THE PREFERRED EMBODIMENTS

The present invention will now be explained in detail with reference to the drawings.

First Embodiment

Figure 1:
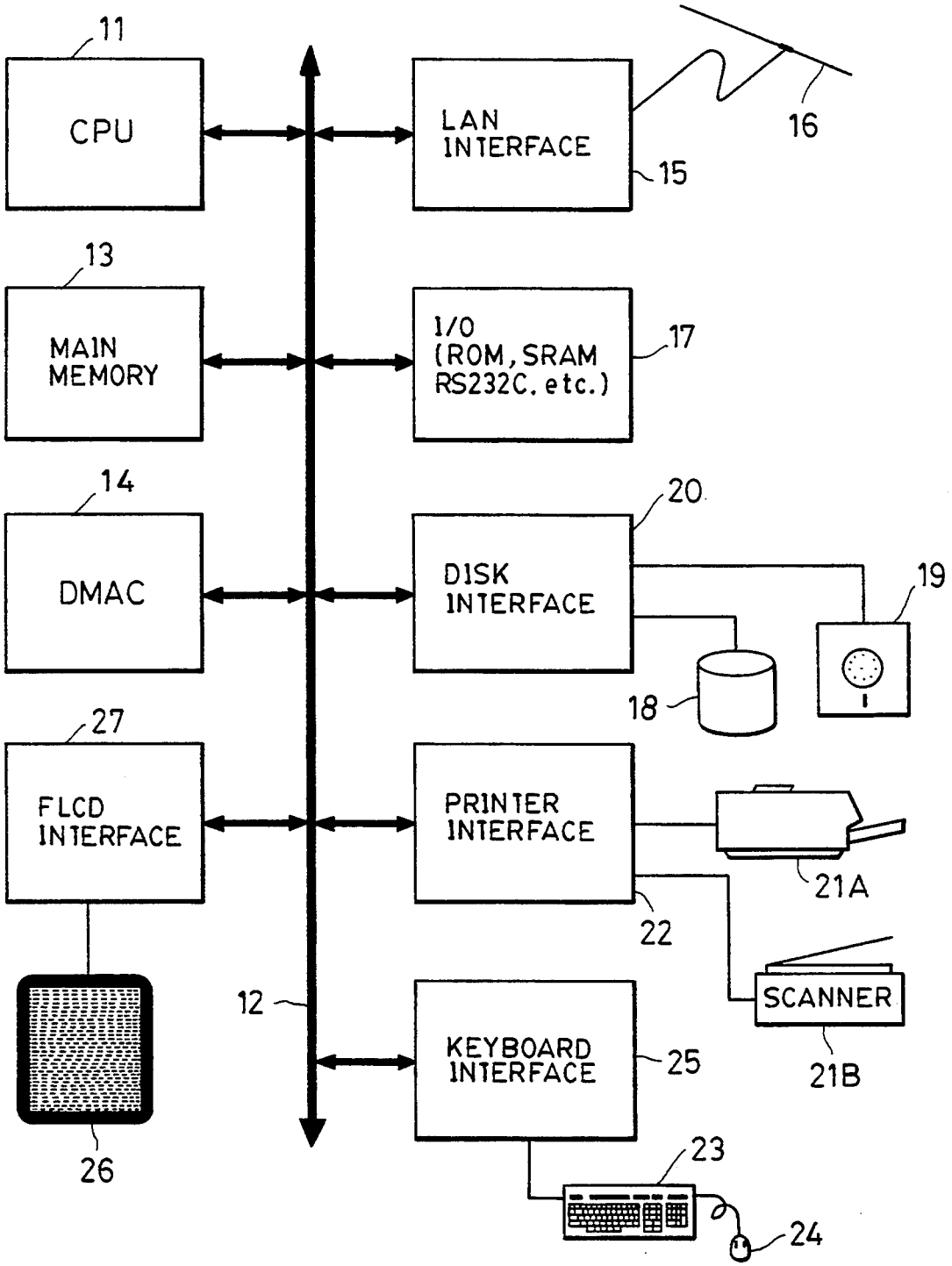
FIG. 1 is a block diagram of the configuration of the entire information processing system incorporating a display control device according to an embodiment of the present invention.

FIG. 1 is a block diagram of the configuration of the entire information processing system incorporating a display control device according to a first embodiment of the present invention.

In FIG. 1, a CPU 11 controls the entire information processing system. System bus 12 comprises an address bus, a control bus and a data bus. A main memory 13 stores programs, and is also used as work areas. A DMA controller 14 (direct memory access controller, hereinafter termed a DMAC) transfers data between memories and I/O apparatuses without passing through the CPU 11. A LAN (local area network) interface 15 is an interface with a LAN 16, such as Ethernet (by Xerox Corporation) or the like. An I/O device 17 is used for the connection with I/O apparatuses, and comprises a ROM (read-only memory), an SRAM (static random access memory), an interface conforming to RS232C and the like. There is also shown a disk interface 20 for a hard disk device 18 and a floppy disk device 19. A high-resolution printer 21A comprises, for example, a laser-beam printer, an ink-jet printer or the like. A scanner 21B serves as an image reading device. An interface 22 is for the printer 21A and the scanner 21B. A keyboard 23 is for inputting characters, numerals and the like. A pointing device is provided such as a mouse 24. An interface 25 is provided for the keyboard 23 and the mouse 24. An FLCD 26 may be configured using a display unit disclosed in, for example, Japanese Patent Application Public Disclosure (Kokai) No. 63-243993 (1988) by the assignee of the present application. An FLCD interface 27 is for the FLCD 26.

In the above-described information processing system which is connected to various kinds of apparatuses, the user of the system generally performs operations in accordance with various kinds of information displayed on the display picture surface of the FLCD 26. That is, characters, image information and the like supplied from external apparatuses connected to LAN 16 and I/O device 17, hard disk 18, floppy disk 19, scanner 21B, keyboard 23 and mouse 24. The operational information stored in the main memory 13 and extracted by the system operation of the user, and the like are displayed on the display picture surface of the FLCD 26. The user performs editing of information and command operations for the system while watching the display. The above-described various kinds of apparatuses serve as display information supply means for the FLCD 26.

Figure 2A:
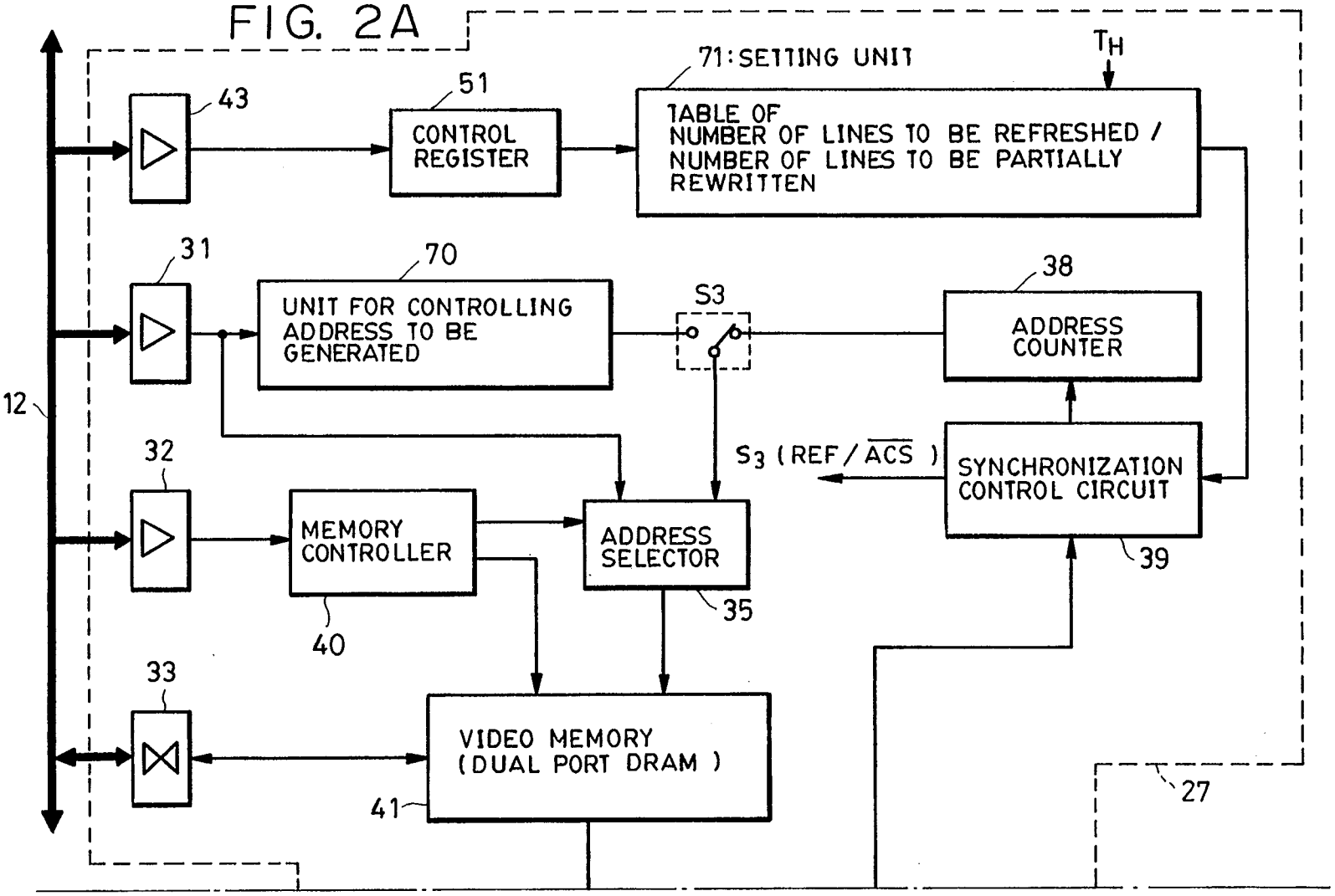
FIG. 2, composed of FIGS. 2A and 2B, is a block diagram showing the configuration of an FLCD interface according to the embodiment.
Figures 2, 2B:
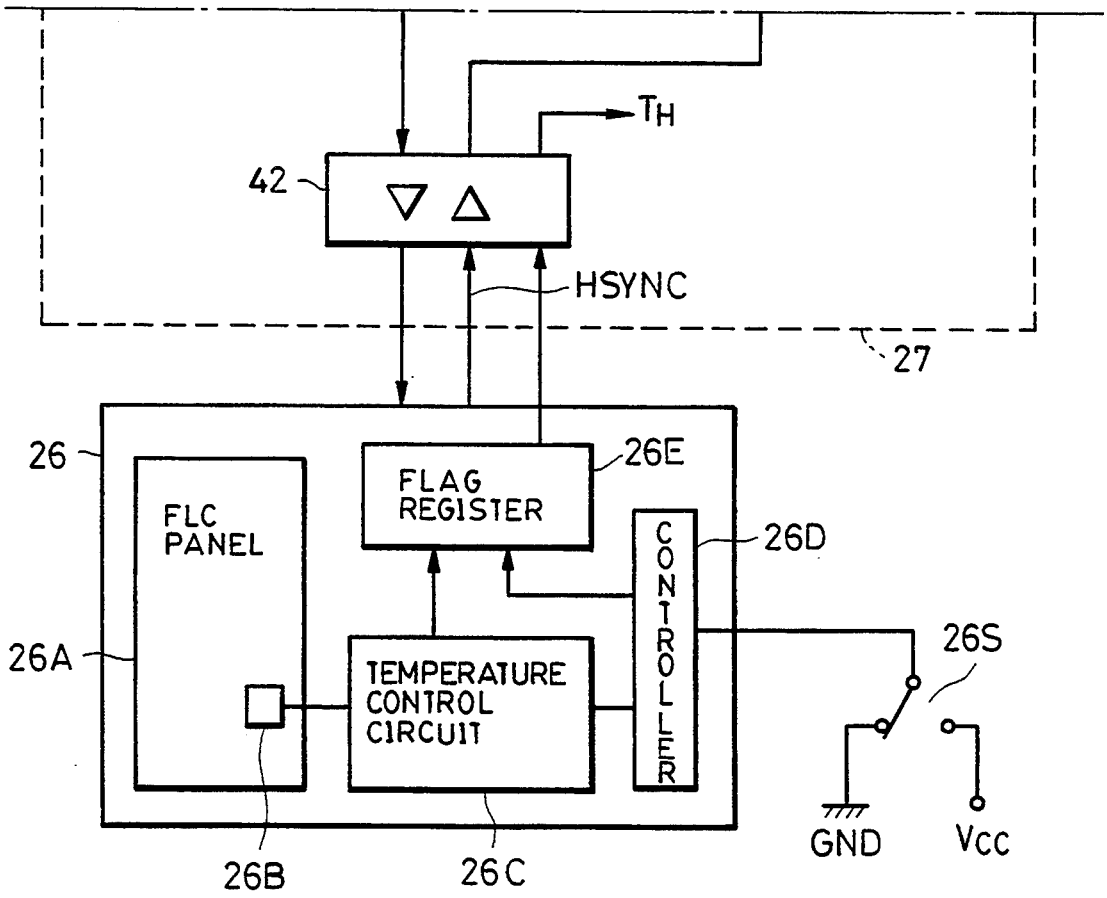

FIG. 2 is a block diagram showing an example of the configuration of the FLCD interface 27, serving as the display control device of the embodiment of the present invention.

In FIG. 2, there are shown an address bus driver 31, a control bus driver 32, and data bus drivers 33 and 43. Address data from the CPU 11 are supplied from the address bus driver 31 to a memory controller 40, one of two input ports of an address selector 35, and a unit 70 for controlling an address to be generated. The unit 70 for controlling an address to be generated detects that the same line has been accessed at least predetermined times, and generates the address of the line. The unit 70 will be described later with reference to FIGS. 7(A) and 7(B).

Address data generated by the unit 70 and address data from an address counter 38 (to be described later) are selectively input to another input port of the address selector 35 by switching a switch S3. The address counter 38 generates address data for line sequentially refreshing the entire picture surface. The timing of the generation of the address data is controlled by a synchronization control circuit 39. The synchronization control circuit 39 also generates a switching control signal for the switch S3 and a data transfer request signal for a memory controller 34 (to be described later).

A control signal from the CPU 11 is supplied from the controller bus driver 32 to the memory controller 40, which generates a control signal for the address selector 35 and a control signal for a video memory 41 (to be described later). The address selector 35 selects one of the two address data input to the input ports of the address selector 35 according to the control signal from the memory controller 40, and supplies the video memory 41 with the selected address data.

The video memory 41, comprising a dual-port DRAM (dynamic random access memory), stores display data, and performs writing and reading of display data via the data bus driver 33. Display data written in the video memory 41 are transferred to the FLCD 26 via a driver/receiver 42, and are displayed on the FLCD 26. The driver/receiver 42 supplies the synchronization control circuit 39 with a synchronizing signal from the FLCD 26.

Data for setting the ratio between the number of lines to be partially rewritten and the number of lines to be subjected to refreshing driving, and the like in accordance with the kind of an image, and the like are supplied to a control register 51 via the data bus driver 43.

A temperature sensor 26B is provided at an FLC panel 26A of the FLCD 26 in order to detect the temperature thereof. A temperature control circuit 26C performs the temperature control of the FLC panel 26A which uses a heater or the like in accordance with a temperature detected by the temperature sensor 26B. The temperature control circuit 26C also sets the value of a flag in a flag register 26E referring to a table, which will be described later with reference to FIG. 5, according to the detected temperature. A controller 26D for controlling the FLCD 26 is provided, for example, on the case of the FLCD 26, and switches the above-described referred table in accordance with a state of a temperature-table switching switch 26S operable by the user. By providing a table in accordance with the switch 26S, it is possible to reduce the number of flags, and to simplify the hardware configuration. A variable resistor may be provided in place of the above-described switch, and a plurality of tables may be provided in accordance with the value of the variable resistor.

A setting unit 71 sets the number of lines to be refreshed and the number of lines to be partially rewritten, and may include a memory storing a table for selecting driving conditions (the numbers of lines subjected to refreshing cycles and partially rewriting cycles (to be described later)) of the FLC panel 26A in accordance with information relating to the kind of an image and the like stored in the control register 51 and information (a temperature flag) relating to the detected temperature. A ROM may be used as the memory if it is not assumed to rewrite the contents of the table from the system side, and a RAM may be used if it is assumed to rewrite the contents of the table. It is possible to control the operation of the synchronization control circuit 39 to properly drive the FLC panel 26A in accordance with the table.

In the above-described configuration, when the CPU 11 changes a display, an address signal for the video memory 41 corresponding to rewriting of desired data is supplied to the memory controller 40 via the address bus driver where arbitration between a memory access request signal of from CPU 11 and a data trasfer request signal from the synchronization control circuit 39 is performed. If the CPU access side obtains priority, the memory controller 40 switches the address selector 35 so as to select the address accessed by the CPU 11 as an address to be provided for the video memory 41. At the same time, the memory controller 40 generates a control signal for the video memory 41, and reading/writing of data is performed via the data bus driver 33. At that time, the CPU-accessed address is also input to the unit 70 for controlling an address to be generated, and an address generated from the unit 70 is utilized when transferring display data (to be described later). As described above, the method of accessing display data from the CPU 11 is entirely the same as in the above-described case for the CRT.

When reading data from the video memory 41 and transferring the read data to the FLCD 26, a data transfer request signal is generated by the synchronization control circuit 39 and is transmitted to the memory controller 40. An address at the side of the address counter 38 is selected as the address for the video memory 41 by the address selector 35, and a control signal for data transfer is generated by the memory controller 40. Data of the proper address are transferred from the memory cell to the shift register, and are output to the driver 42 by a serial-port control signal.

The synchronization control circuit 39 generates timings for generating cycles to line-sequentially refreshing the entire picture surface in units of a plurality of lines according to a horizontal synchronizing signal HSYNC from the FLCD 26, and partially rewriting cycles to rewrite lines accessed by the CPU 11. In the entire-surface refreshing cycles, rewriting is sequentially performed from the uppermost line (the leading line) on the display picture surface to the lower lines. When rewriting has been performed until the lowest line, rewriting is repeated with returning to the leading line. In rewriting cycles of accessed lines (partially rewriting cycles), lines accessed by the CPU 11 at least predetermined times are rewritten.

In the present embodiment, basically, the operation of sequentially refreshing the entire picture surface of the FLCD 26 and the operation of rewriting lines accessed by the CPU 11 at least predetermined times in order to change the contents of display are alternately performed using time division. In addition, the number of lines subjected to the above-described cycles may be set in accordance with the kind of image data, temperature conditions and the like.

Figure 3A:
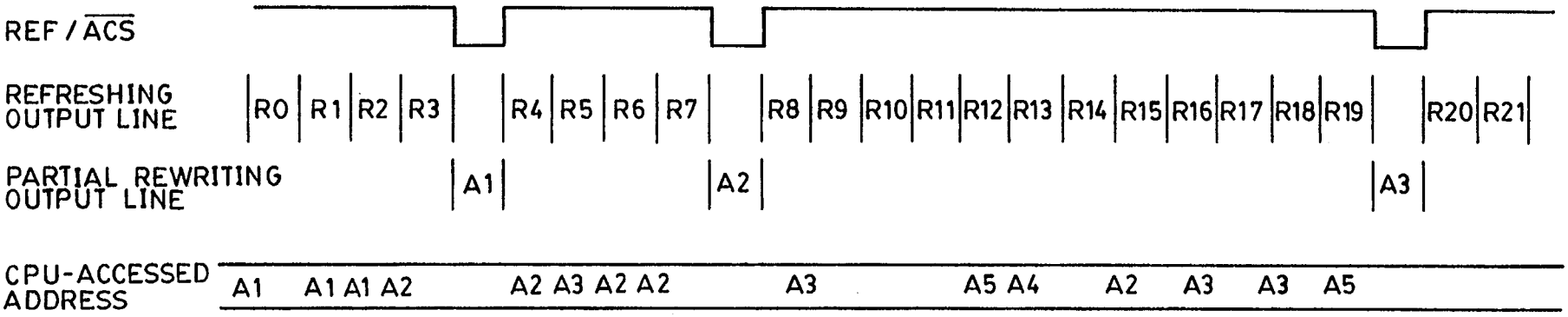
FIGS. 3(A) and 3(B) are timing charts illustrating the basic operation of the FLCD interface shown in FIG. 2.
Figure 3:
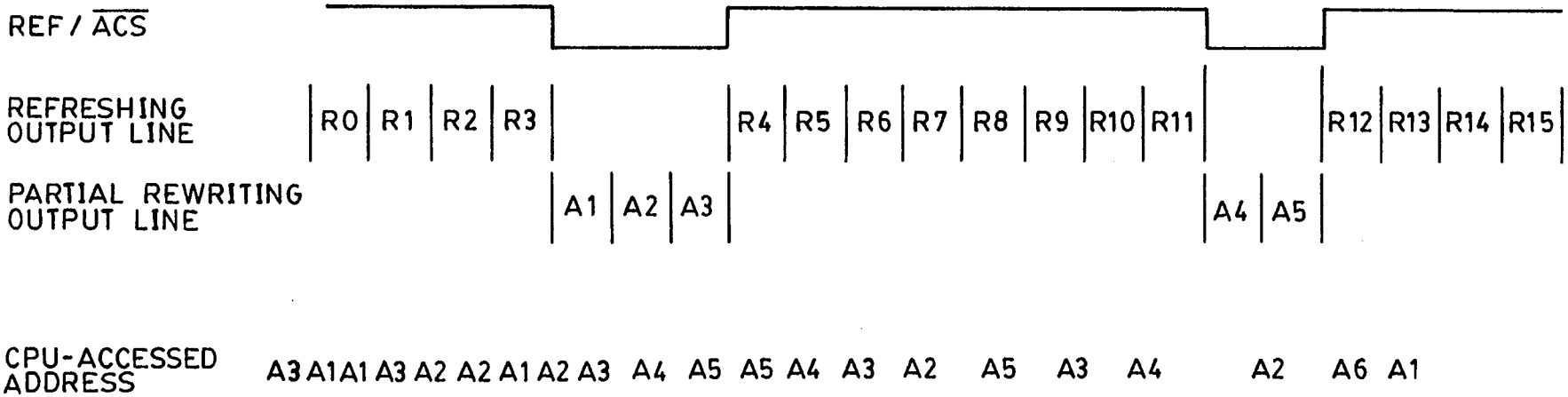

First, an explanation will be provided of the basic operation of the present embodiment wherein the refreshing operation and the line-rewriting operation are alternately performed with reference to FIGS. 3(A) and 3(B). FIGS. 3(A) and 3(B) show a case wherein the refreshing cycles are performed in units of 4 lines, and in the rewriting cycles, a line is rewritten when the line has been accessed at least three times. In FIGS. 3(A) and 3(B), REF/$\overline{\text{ACS}}$ represents timings to generate entire-surface refreshing cycles and rewriting cycles for accessed lines. Level "1" indicates cycles for total refreshing cycles, and level "0" indicates cycles for rewriting cycles for accessed lines.

FIG. 3(A) illustrates processing when priority must be or is preferred to be given to refreshing cycles. Only one line is output in a partial rewriting cycle after a refreshing cycle for 4 lines. A partial rewriting cycle is executed and output only if there is a line which has been accessed by the CPU 11 at least three times. FIG. 3(B) illustrates processing when priority must be or is preferred to be given partial rewriting cycles, because of frequent accesses from the CPU 11, or the like. All the lines accessed at least three times are output in a partial rewriting cycle after a refreshing cycle for 4 lines. The above-described cases are of course mere examples. In practice, the number of lines to be subjected to refreshing cycles and partial rewriting cycles may be selected in a finer manner.

When one refreshing cycle of the entire picture surface has been completed, and the FLCD 26 has output a vertical synchronizing signal VSYNC or when a carry has been generated in the address counter 38, the address counter 38 is cleared, the line to be output in an entire-surface refreshing cycle is returned to the 0-th line, and lines are sequentially counted up as "1", "2", "3", . . . for every horizontal synchronizing signal (HSYNC) provided from the FLCD 26 via the synchronization control circuit 39. In accordance with this operation, the addresses of the 0-th line–the 3rd-line (indicated by R0–R3 in FIGS. 3(A) and 3(B)) are sequentially output to perform refreshing.

In the example shown in FIG. 3(A), since only line A1 has been accessed at least three times until the end of the refreshing period, and only one line is permitted to be output in a partial rewriting cycle, only line A1 is output. On the other hand, in the example shown in FIG. 3(B), lines A1 and A2 have been accessed three times, and line A3 has been accessed twice until the end of the refreshing period, lines A1 and A2 are output in the partial rewriting cycle. During the outputs of lines A1 and A2, line A3 has been accessed again. Since all the lines accessed at least three times are permitted to be output in this case, line A3 is then output.

When the partial rewriting cycle has ended, lines R4, R5, R6 and R7 are output as the continuation of the preceding refreshing cycle. In the example shown in FIG. 3(A), line A2 has been accessed at least three times at that time, line A2 is partially rewritten. On the other hand, in the example shown in FIG. 3(B), since no lines have been accessed at least three times, the refreshing cycle is continued without interruption. The same operation is thereafter performed.

As described above, in the basic operation of the present embodiment, the refreshing cycle and the line-rewriting cycle are alternately repeated, and the number of lines subjected to respective cycles may be changed. The number of lines is changed according to a refreshing rate and the like requested in accordance with environmental conditions, such as temperature and the like, the kind of data to be displayed, a difference in the display-device material for the FLCD, and the like. That is, by increasing the number of lines within the refreshing cycle, or by decreasing the number of lines within the partial rewriting cycle, the refreshing rate can be increased, providing an excellent display state even if the responsiveness of the FLCD is low, for example, at a low temperature, or an image is displayed. On the contrary, by decreasing the number of lines within the refreshing cycle, or by increasing the number of lines within the partial rewriting cycle, the responsiveness in a partial change of display can be increased. Hence, it becomes possible to deal with a case wherein a high refreshing rate is not needed, for example, at a high temperature, in displaying characters, or the like.

In the present embodiment, since it is possible to preferentially partially rewrite lines accessed relatively often by the CPU, a high-efficiency operation can be achieved.

Figures 4, 5:
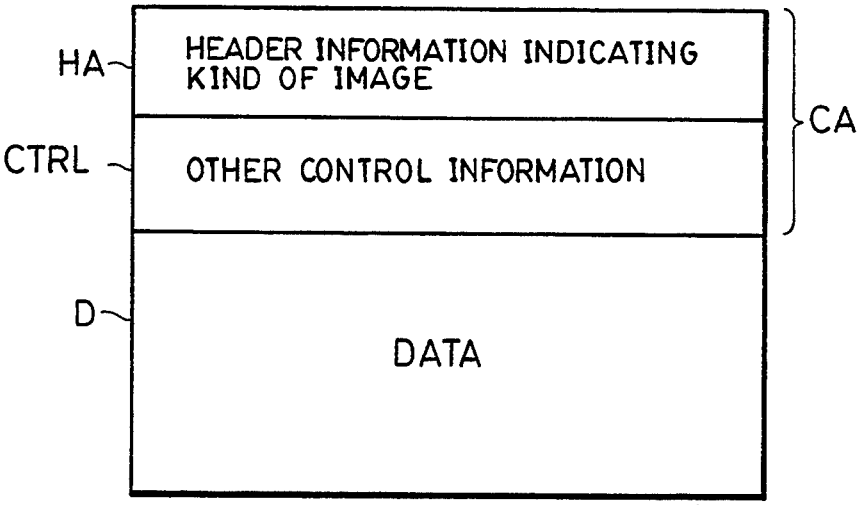
FIG. 4 is a block diagram showing an example of the structure of data to be processed in the information processing system shown in FIG. 1.
FIG. 5 is a conceptual diagram showing a temperature flag table which a temperature control circuit shown in FIG. 2 has.

FIG. 4 shows an example of the structure of data to be processed in the system shown in FIG. 1. One unit of data comprises a control area CA and a data area D. In the data area D, data for character strings comprising characters, numerals and the like, and data for line drawings, natural pictures, photographs and the like, are expanded. The control area CA includes an area CTRL for control information (for example, data sizes, the pitch between characters in the case of character data, and other information) relating to the expanded data, and an area HA for header information indicating the kind of an image.

When the user inputs a document or the like using the keyboard 23, information indicating that the data comprise character strings and the like is provided in the area HA, and control information for editing and other purposes is added to the area CTRL. When performing an input using the scanner 21B, information of a mode set for the reading (a character mode for reading character strings, a photograph mode for reading photographs, a photograph fine mode for clearly reading photographs, or the like) is expanded in the header information area HA, and other kinds of control information are expanded in the area CTRL. Data after adding the control area CA thus set are registered in the hard disk or the floppy disk in the form of a file.

In the present embodiment, in displaying an image input from the scanner 21B or the like, characters input from the keyboard 23 or the like, a file read from the hard disk or the floppy disk, information indicating the kind of the image to be displayed is extracted from the header information area HA, and is stored in the control register 51 shown in FIG. 2 as header information H. The user may change the contents of the header information area HA, and may select the picture quality of the display.

FIG. 5 is a conceptual digram showing a temperature flag table posessed by the temperature control circuit 26C shown in FIG. 2. As is apparent from FIG. 5, four kinds of flags each comprising two bits are selected in accordance with the temperature detected by the temperature sensor 26B and the state of the switch 26S, and is set in the flag register 26E. As described above, the switch 26S is operated by the user, and the user may switch the switch 26S to side A or B in accordance with picture quality or the like.

Figure 6:
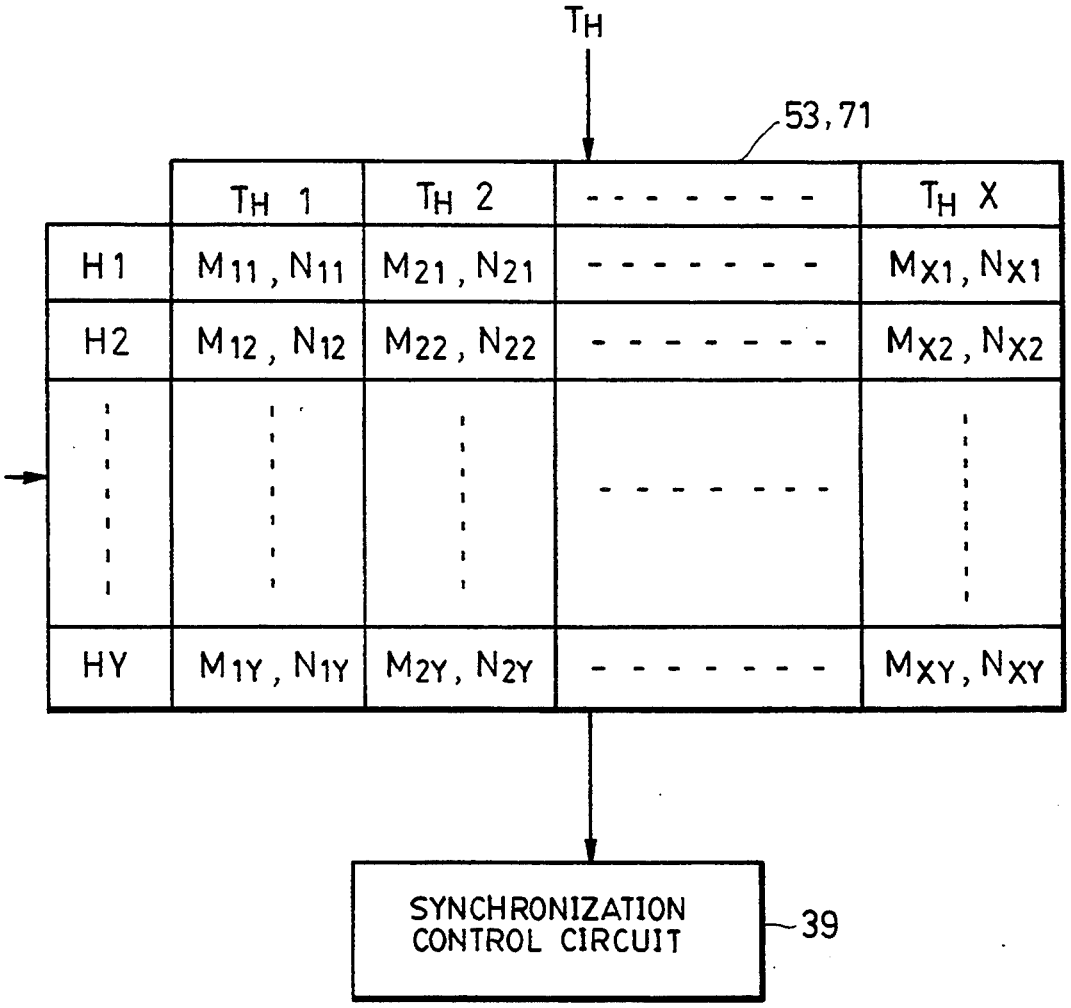
FIG. 6 is a conceptual diagram showing an example of the configuration of a setting unit shown in FIG. 2.

FIG. 6 shows an example of the configuration of the setting unit 71 for selecting an optimum repetition period and the number of lines to be subjected to the refreshing cycle/partial rewriting cycle in accordance with the header information H indicating the kind of an image (characters, a line drawing, a natural picture, a photograph, a fine photograph, or the like) and temperature information $T_H$. As shown in FIG. 6, the setting unit 71 has a table storing respective value M (the number of lines within one refreshing cycle) and value N (the number of lines within one partial rewriting cycle) in accordance with a combination of header information H1, H2, - - - , HY indicating the kind of an image, and information $T_H1$, $T_H2$, - - - , $T_HX$ (four kinds in the present embodiment) corresponding to the temperature flag.

Figure 9:
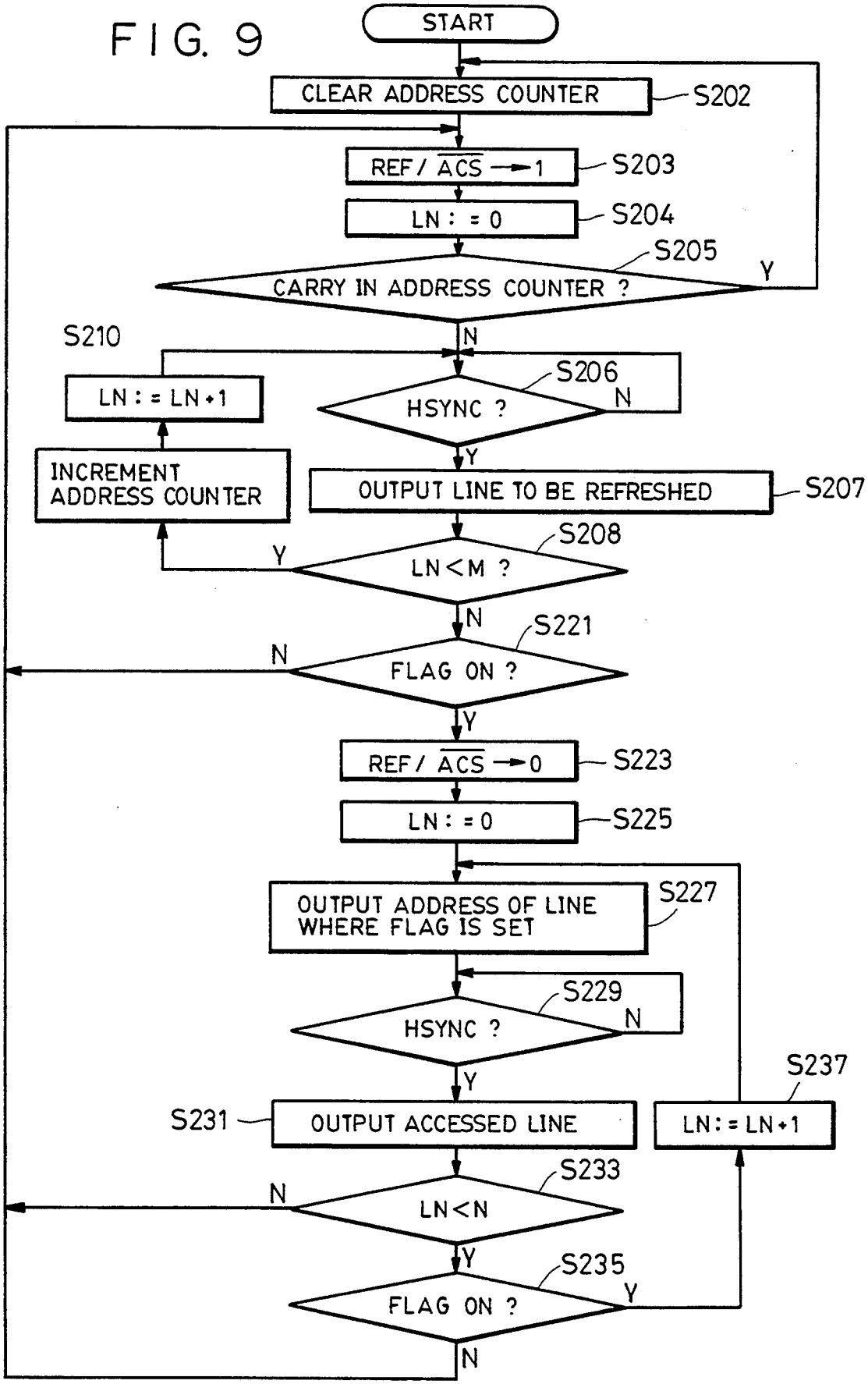
FIG. 9 is a flowchart showing a display operation procedure performed by respective units of the system shown in FIG. 2.

Accordingly, during a display control operation FIG. 9), certain values M and N are read in accordance with the header information H and the temperature information $T_H$ at that time period. In accordance with the read values, a counter (not shown) in the synchronization control circuit 39 counts synchronizing signals HSYNC, and outputs a signal REF/$\overline{\text{ACS}}$. By such combinations of the values M and N, various kinds of driving conditions are properly selected from a case wherein priority is given for refreshing (for example, the case shown in FIG. 3(A)) to a case wherein priority is given for partial rewriting (the case shown in FIG. 3(B)).

Figure 7:
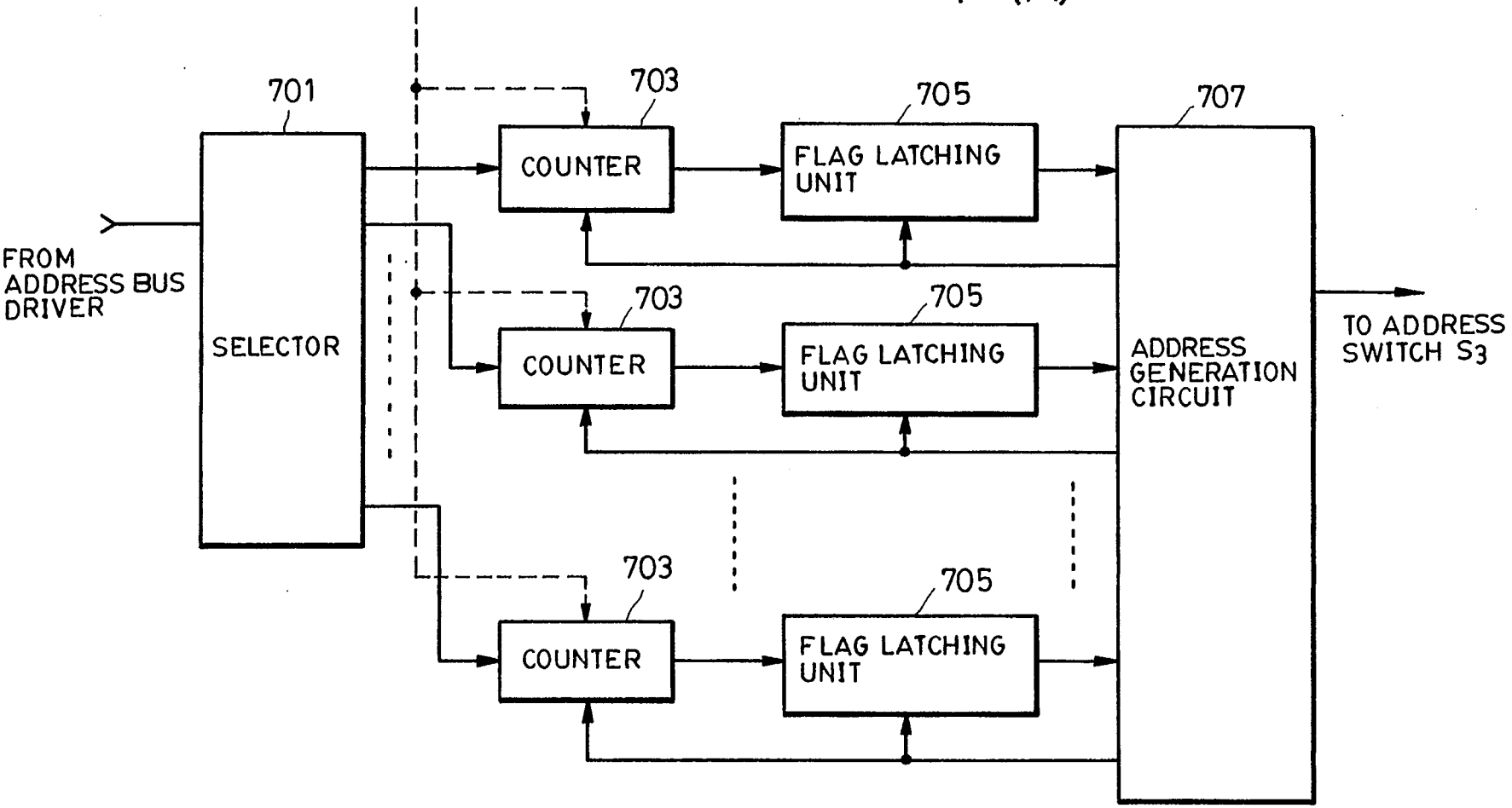
FIG. 7(A) is a block diagram showing an example of the specific configuration of a unit for controlling an address to be generated shown in FIG. 2.
FIG. 7(B) is a flowchart illustrating an operation of the unit for controlling an address to be generated shown in FIG. 2(A)

FIG. 7(A) shows an example of the specific configuration of the unit 70 for controlling an address to be generated in the present embodiment. In FIG. 7(A), counters 703 are provided as many as the number of lines corresponding to line devices of the display unit. In accordance with an address accessed by the CPU 11 input from the address bus driver 31, a selector 701 transmits an incrementing signal to the corresponding counter. Flag latching units 705 are provided corresponding to the respective counters 703. Each latching unit 705 sets and latches a flag when the count value has reached a set value (for example, "3" in FIGS. 3(A) and 3(B)), and a carry has been generated in the corresponding counter 703. An address generation circuit 707 generates the address of the corresponding line in accordance with the setting of the flag, and transmits the address to the switch S3.

Figure 7B:
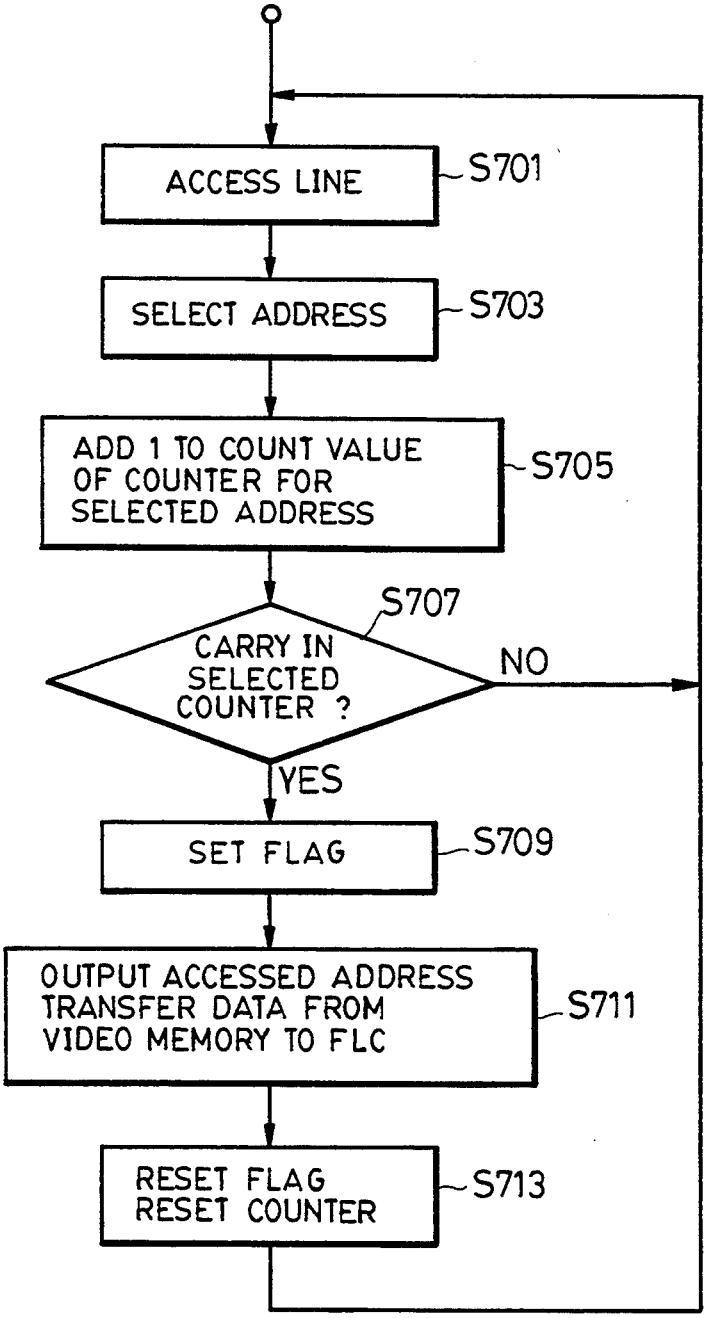

FIG. 7(B) is a flowchart illustrating the operation of the above-described configuration. First, when a line has been accessed at step S701, the selector 701 selects the counter corresponding to the address of the line at step S703, and transmits an incrementing signal to the counter to increment the count value by one. If no carry has been generated in the counter, the process returns to step S701 via step S707. If a carry has been generated in the counter, a flag is set in the corresponding flag latch unit 705 at step S709. At step S711, the corresponding address is output from the address generation circuit 707, and data of the line indicated by the address are transferred from the video memory 41 to the FLCD 26. Subsequently, at step S713, the flag latch unit 705 and the counter 703 corresponding to the line having the address are reset, and the process returns to step S701.

By the above-described operation, even when the CPU 11 has continuously and repeatedly accessed a plurality of continuous lines (for example, lines A1-6–A31) in order to display a character string on a row comprising the plurality of lines, it becomes possible to perform an instantaneous display in accordance with the frequency of repetition.

Although, in the foregoing embodiment, the set value of the counter is "3", any appropriate number may of course be set. The value may be fixed, or may be changed in accordance with setting. When changing the number, the number may be set by the CPU 11 as shown by broken lines in FIG. 7(A). Alternatively, set values may be provided in the table of the setting unit 71, and may be reset in a counter with an appropriate timing. It is thereby possible to perform a finer control.

Figure 8:
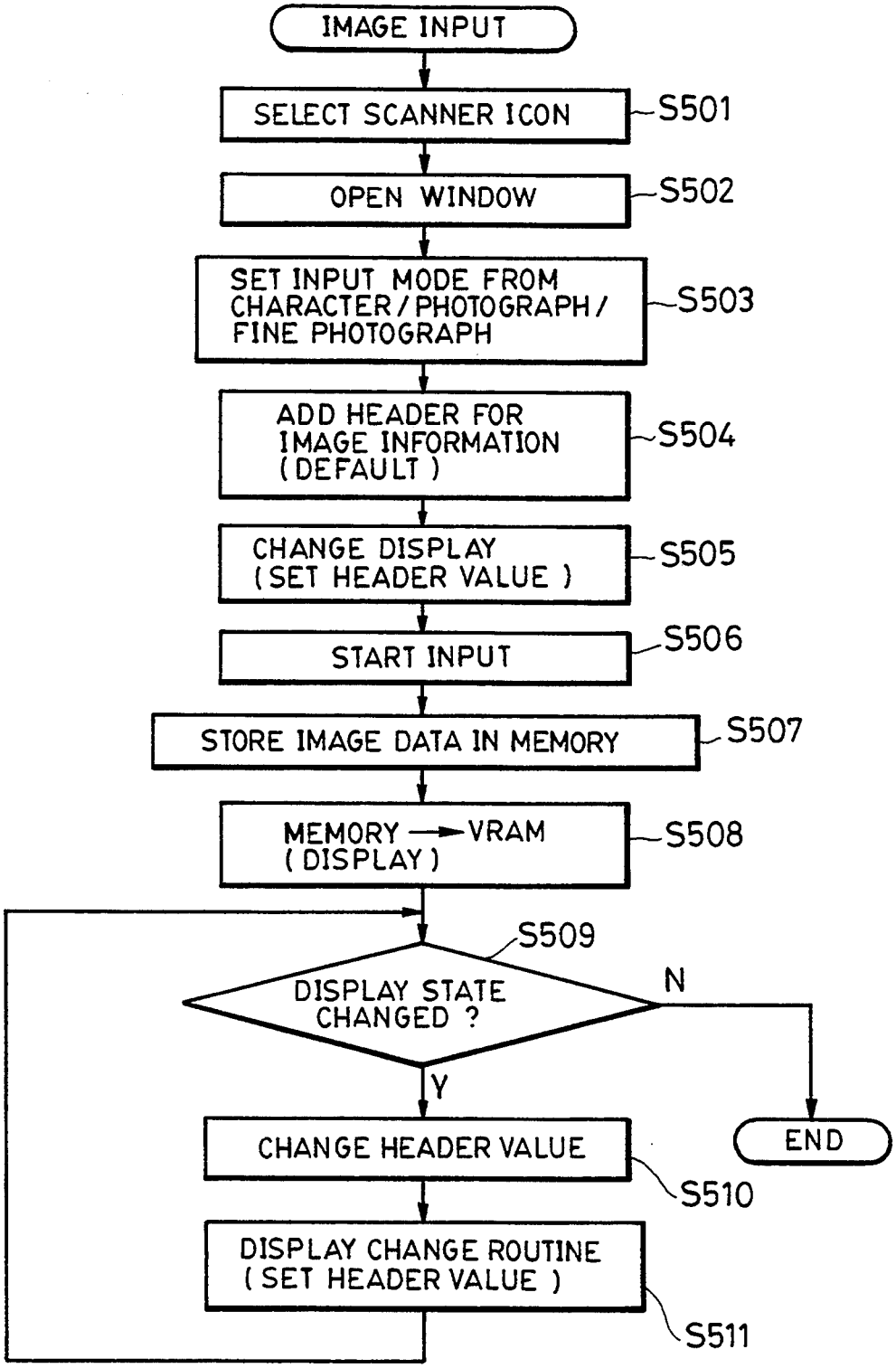
FIGS. 8(A)–8(D) are flowcharts showing a control procedure by a CPU of the information processing system shown in FIG. 1.
Figure 8B:
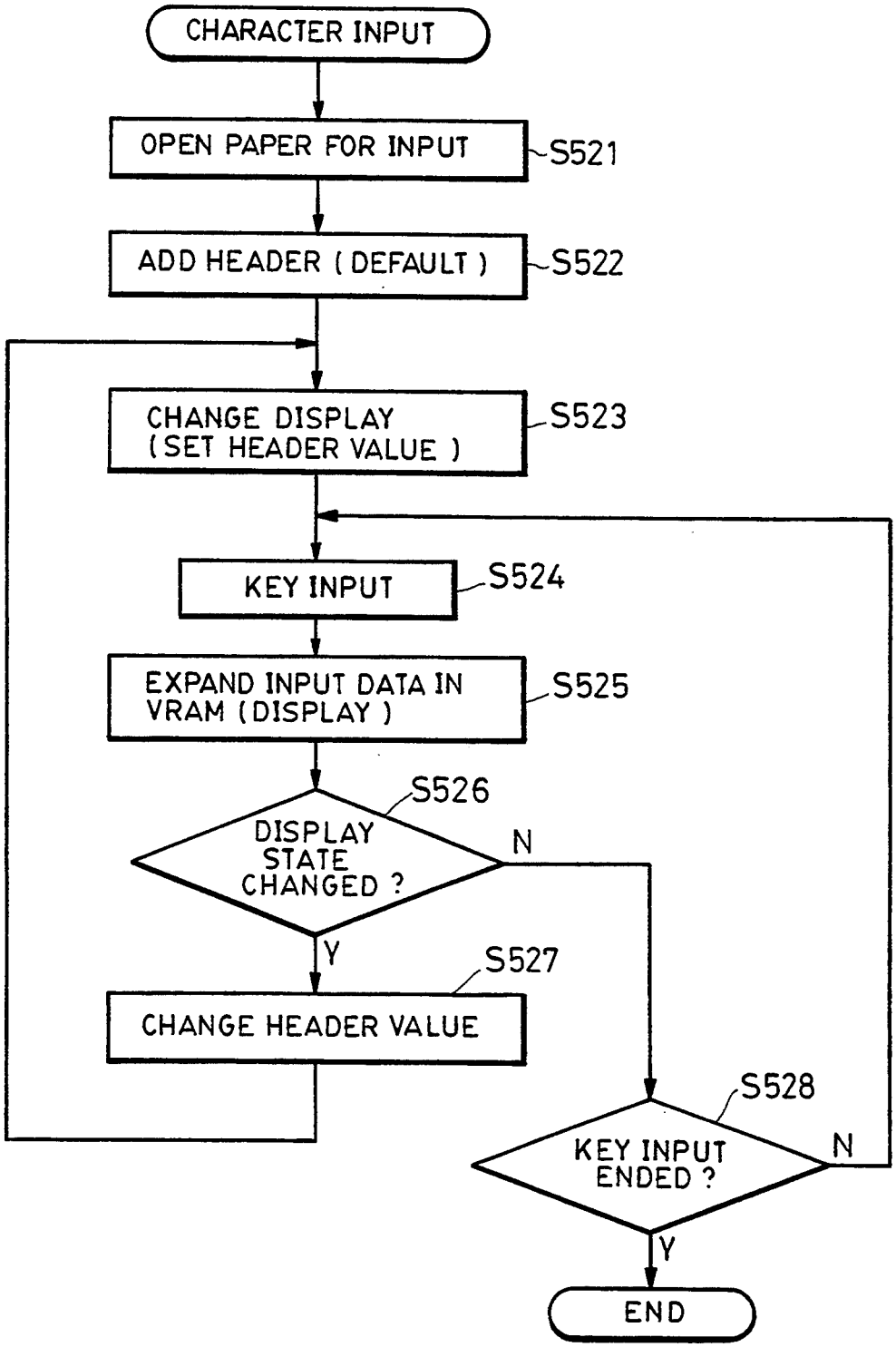
Figure 8C:
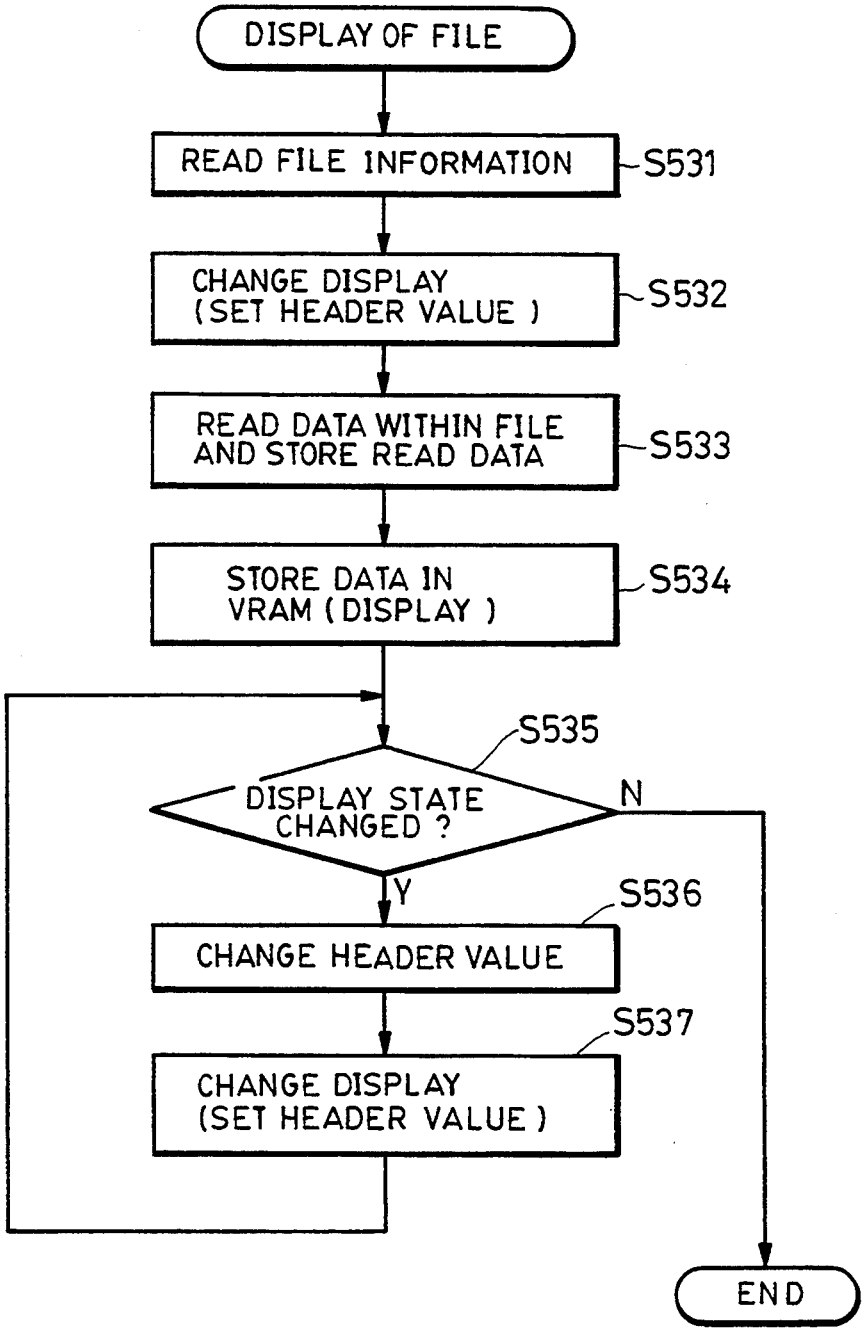
Figure 8D:
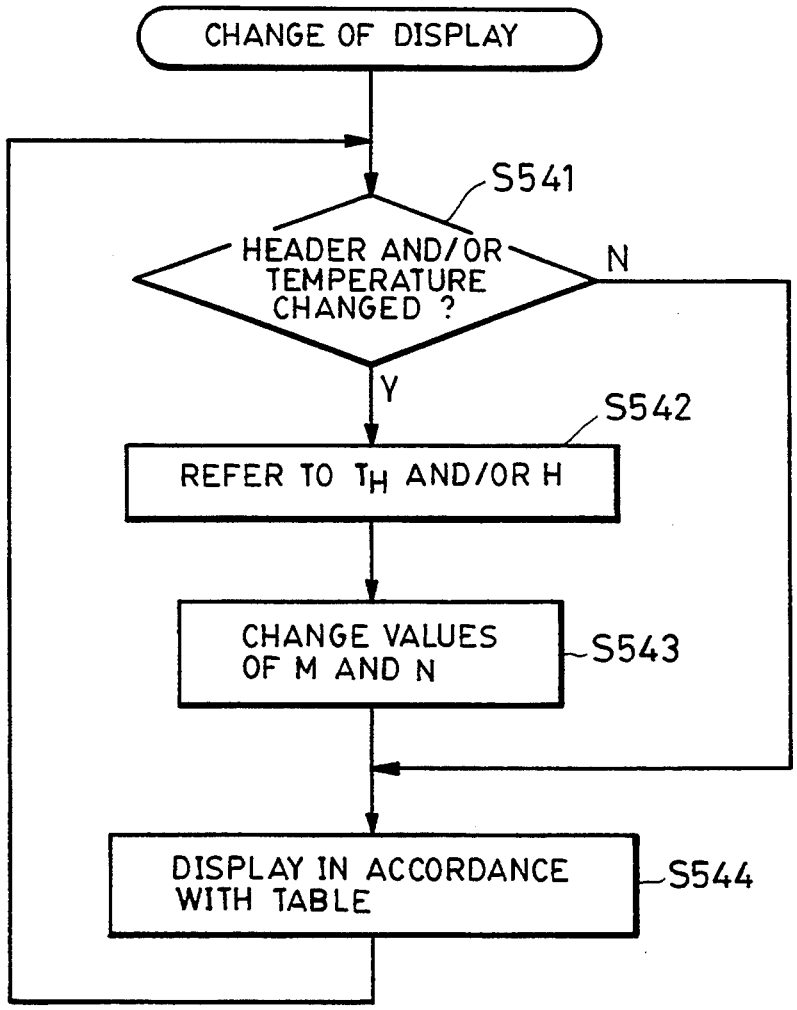

FIGS. 8(A)–8(C) are flowcharts showing control procedures by the CPU 11 accompanying the operation of the user in the information processing system shown in FIG. 1 according to the embodiment of the present invention. FIG. 8(D) is a flowchart showing an operation procedure of the FLCD 27 in accordance with the above-described control procedures.

FIG. 8(A) shows a control procedure in an image input mode by the scanner 21B, and when displaying the input data on the FLCD 26. At step S501, a scanner icon on the display picture surface of the FLCD 26 is selected, for example, by the operation of the mouse 24 by the user. At step S502, a window for displaying an input image on a predetermined portion of the display picture surface is opened. At step S503, the user sets an input mode from among character, photograph and fine photograph modes in accordance with the image input by the scanner 21B. At step S504, header information as described with reference to FIG. 4 is selected in default from among a plurality of predetermined header values, and the selected information is added. At the same time, at step S505, the header information is set in an image data header register 44A shown in FIG. 2.

Subsequently, at step S506, the input operation by the scanner 21B is started. At step S507, input image data are first stored in the main memory 13 in order to adjust resolution between the scanner 21B and the FLCD 26. Subsequently, at step S508, the image data are expanded in the video memory 41, and are displayed.

Subsequently, at step S509, it is determined whether or not the user has changed the display state by operating, for example, a knob provided at the FLCD 26 in order to change the display picture quality. If the result of determination is affirmative, at step S510, another header value is selected from among the above-described plurality of header values in accordance with the change. At step S511, the header information is set in the control register 51. If the result of determination at step S509 is negative, the processing is terminated.

FIG. 8(B) showns a control procedure in a character input mode corresponding to a word processor. If the present processing is started, for example, by a predetermined key operation on the keyboard 23, paper for input is displayed on a predetermined portion of the display picture surface. At step S522, a predetermined header value is selected in default from among the above-described plurality of header values, and the selected header value is added to a predetermined area in the memory. At step S523, the header value is set in the control register 51.

Subsequently, at step 8524, key input is performed. At step S525, key input data are expanded in the video memory 41, and are displayed.

Subsequently, at step S526, it is determined whether or not the user has changed the display state, in the same manner as in the control procedure shown in FIG. 8(A). If the result of determination is affirmative, the header value is changed at step S527. The process then returns to step S523, where the header value is set in the register 44A in order to change the display. If the result of determination at step S526 is negative, it is determined whether or not the key input, has ended at step S528. If the result of determination is affirmative, the present processing is terminated. If the result of determination is negative, the process returns to step S524.

FIG. 8(C) shows the control procedure of a file display mode for displaying a file stored in the hard disk 18 or the floppy disk 19.

When the present processing has been started, header information for the file is read at step 8531. At step S532, header information added to the file is set in the control register 51. Subsequently, at step S533, data within the file are stored in the memory 13 in order to perform the above-described adjustment of resolution and the like. At step S534, these data are expanded in the video memory 41, and are displayed. At steps S535–S537, the same processing as the processing at steps S509–S511 shown in FIG. 8(A) is performed.

FIG. 8(D) shows the operation of the FLCD interface 27 corresponding to respective control procedures shown in FIGS. 8(A)–8(C).

That is, if there has been any change in the contents of the control register 51 at step S541, or temperature has changed, the FLCD interface 27 receives an input or inputs of the value H and/or the value $T_H$ which changed at step S542. At step S543, the values M and N are reset. Accordingly, at step S544, the operation of the synchronization control circuit 39 in accordance with the values M and N is performed.

FIG. 9 illustrates a display operation procedure performed by respective units shown in FIG. 2.

First, at step S202, the address counter 38 is cleared, and the refreshing address in the address counter 38 is set to an initial value, for example, "0". Subsequently, at step S203, REF/$\overline{\text{ACS}}$ is set to "1" so that the entire-surface refreshing cycle is performed. The counter for counting the number of transferred lines within one refreshing or partial rewriting cycle (one refreshing cycle in this case) is cleared to set the count value LN to "0".

Subsequently, at step S205, it is determined whether or not the current status is during a period (a flyback period) wherein the refreshing cycle has been completed until the last line and a carry is generated in the address counter. If the result of determination is affirmative, the process returns to step S202. If the result of determination is negative, at step S206, the arrival of a signal HSYNC is awaited. If a signal HSYNC has arrived, data of lines indicated by refreshing-line addresses are transferred to the FLCD 26. At step S208, it is determined whether or not the number M of lines (set by the setting unit 53) to be transferred by one entire-surface refreshing cycle has been cleared. If the count value LN is less than the number M, the process proceeds to step S209, where the address counter 38 is counted up. At step S210, the value LN is incremented by one, and the process returns to step S206. This processing is repeated until M lines are transferred. Since M=4 in the case shown in FIGS. 3(A) and 3(B), the loop from step S206 to step S210 is repeated four times.

Subsequently, at step S221, it is detected whether or not any flag described with reference to FIG. 7(A) has been set. If no flag has been set, the process returns to step S203. The refreshing cycle for the next M lines is then performed.

On the other hand, if a flag has been set at step S221, at step S223, REF/$\overline{\text{ACS}}$ is set to "0" in order to rewrite accessed lines. At step S225, the count value LN is again set to "0" in order to count the number of transferred lines during the rewriting operation of the accessed lines. At step S227, the address generation circuit outputs the address of the line for which the flag is set.

At step S229, the arrival of the signal HSYNC is awaited. When the signal HSYNC has arrived, data of the address of the line output at step S227 are transferred to the FLCD 26. Subsequently, at step S233, it is determined whether or not the transfer of lines has been completed for N (set by the setting unit 53) lines. If the count value LN is less than the value N, the process proceeds to step S235, where it is detected whether or not any other flag has been set. If the result of detection is affirmative, the process proceeds to step S237, where the value LN is incremented by one. The process then returns to S227. This processing is repeated until the transfer of N lines is completed, or until no lines for which flags are set are detected. When the transfer of N lines has been completed, or when no flag setting has been detected, the process returns again to step S203 in order to resume the entire-surface refreshing cycle.

As described above, the display of the contents of the video memory 41 is performed by executing the entire-surface refreshing cycle from step S203 to step S208, executing the rewriting cycle of accessed lines from step S227 to step S235 if necessary or in accordance with operation conditions, returning the line for the entire-surface refreshing cycle to the leading line when a carry has been generated in the address counter 37, and initializing the signal. On the other hand, in order to obtain the displayed contents, the CPU 11 may read data from and write data in the video memory 41 independently of the above-described display operation.

As described above, reading of data from the video memory 41 and transfer of the read data to the FLCD 26 do not require command interpretation, can be configured by relatively simple circuitry, and can be realized with a lower cost than performing display control by executing command interpretation with providing a graphic processor and the like. Hence, it is possible to improve the performance while reducing the cost of the entire system.

The present invention is not limited to the above-described embodiment, but various changes and modifications may of course be made within the true spirit and scope of the present invention.

For example, within the range of the number of lines subjected to partial rewriting set as in the above-described embodiment, the number P of lines subject to actual partial rewriting during a refreshing cycle may be adjusted in accordance with the number of lines accessed by the CPU 11 and the status of line access. Thus, by dynamically adjusting time $T_b$ in accordance with the number of lines accessed by the CPU 11, it is possible to omit useless line rewriting cycles when lines are hardly addressed by the CPU 11 to increase a refreshing rate, and hence to dynamically optimize the relationship between the follow-up capability of the operation and the refreshing rate.

Although, in the foregoing embodiment, the repetition frequency, and the ratio between the refreshing cycle and the partial rewriting cycle are set during the operation period according to temperature information and the kind of an image, the timing of the setting may be appropriately determined. For example, the setting may be performed during a flyback period. Furthermore, in addition to temperature information, other environmental conditions may be considered. If there is no problem, the setting may be performed according to either one of environmental conditions, such as temperature information and the like, and the kind of an image. Furthermore, the above-described value M may be fixed to a predetermined value. Moreover, a unit of access and display may be set to a plurality of lines.

In the foregoing embodiment, it is detected whether or not there is any line accessed at least predetermined times for every refreshing cycle for a set number of lines, and if the result of detection is affirmative, a partial rewriting cycle within the range of the set number of lines is performed in accordance with temperature information and the kind of an image. However, such detection and the subsequent partial rewriting cycle may be performed not for every refreshing cycle of the set number of lines, but may be performed at any appropriate time.

Figure 10:
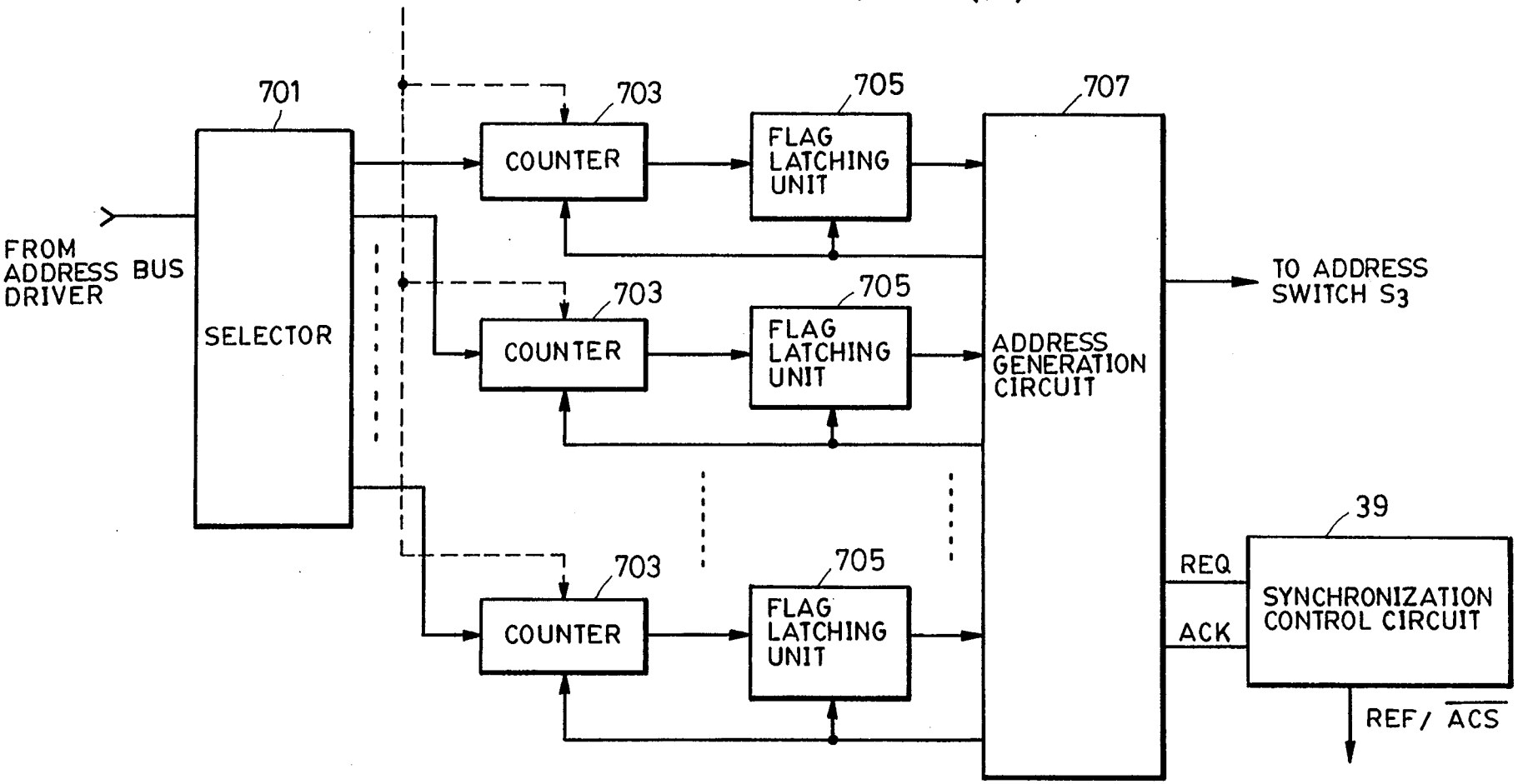
FIG. 10(A) is a block diagram showing another example of the specific configuration of the unit for controlling an address to, be generated shown in FIG. 2.
FIG. 10(B) is a timing chart illustrating an operation of the unit for controlling an address to be generated shown in FIG. 10(A)
Figure 10B:
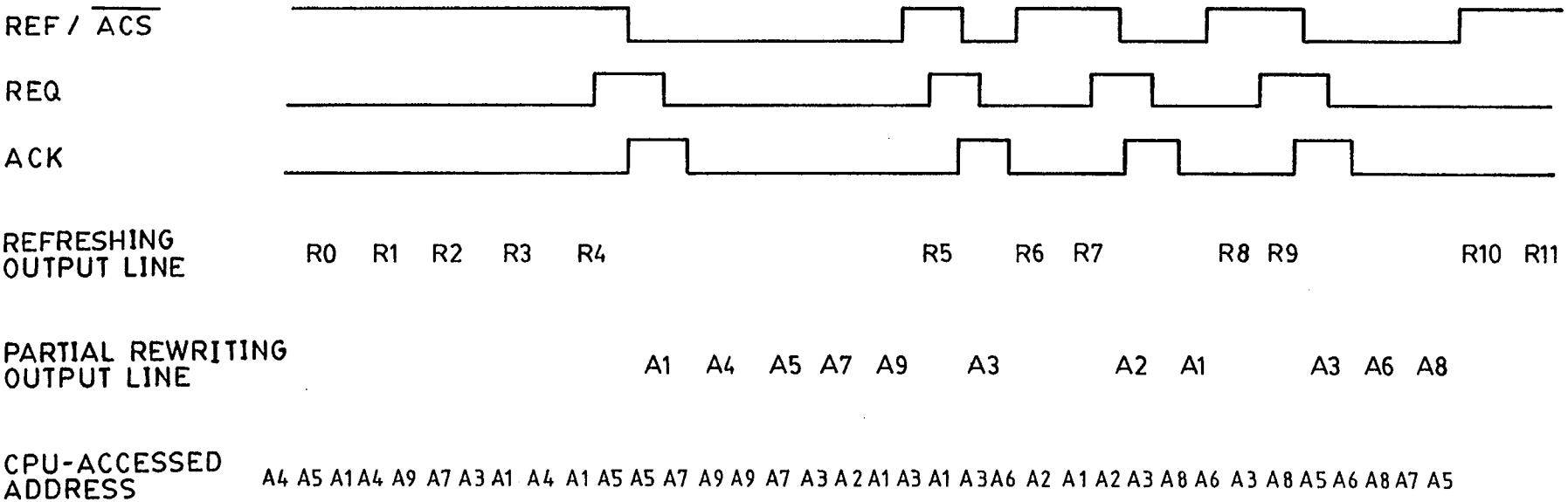

FIG. 10(A) shows an example of the configuration of the unit for controlling an address to be generated for that purpose. In the present embodiment, almost the same configuration as in the embodiment shown in FIG. 7(A) is adopted. However, the address generation circuit 707 in the present embodiment transmits a signal REQ for requesting the synchronization control circuit 39 to shift to the partial rewriting cycle if there is any line for which a flag has been set. In accordance with this operation, the synchronization control circuit 39 sets REF/$\overline{\text{ACS}}$ to "0", stops the transmission of the signal HSYNC to the address counter 35, and transmits an acknowledging signal ACK to the address generation circuit 707 for permission to output the addresses of all the lines for which flags have been set. FIG. 10(B) shows an example of the operation.

Figure 11:
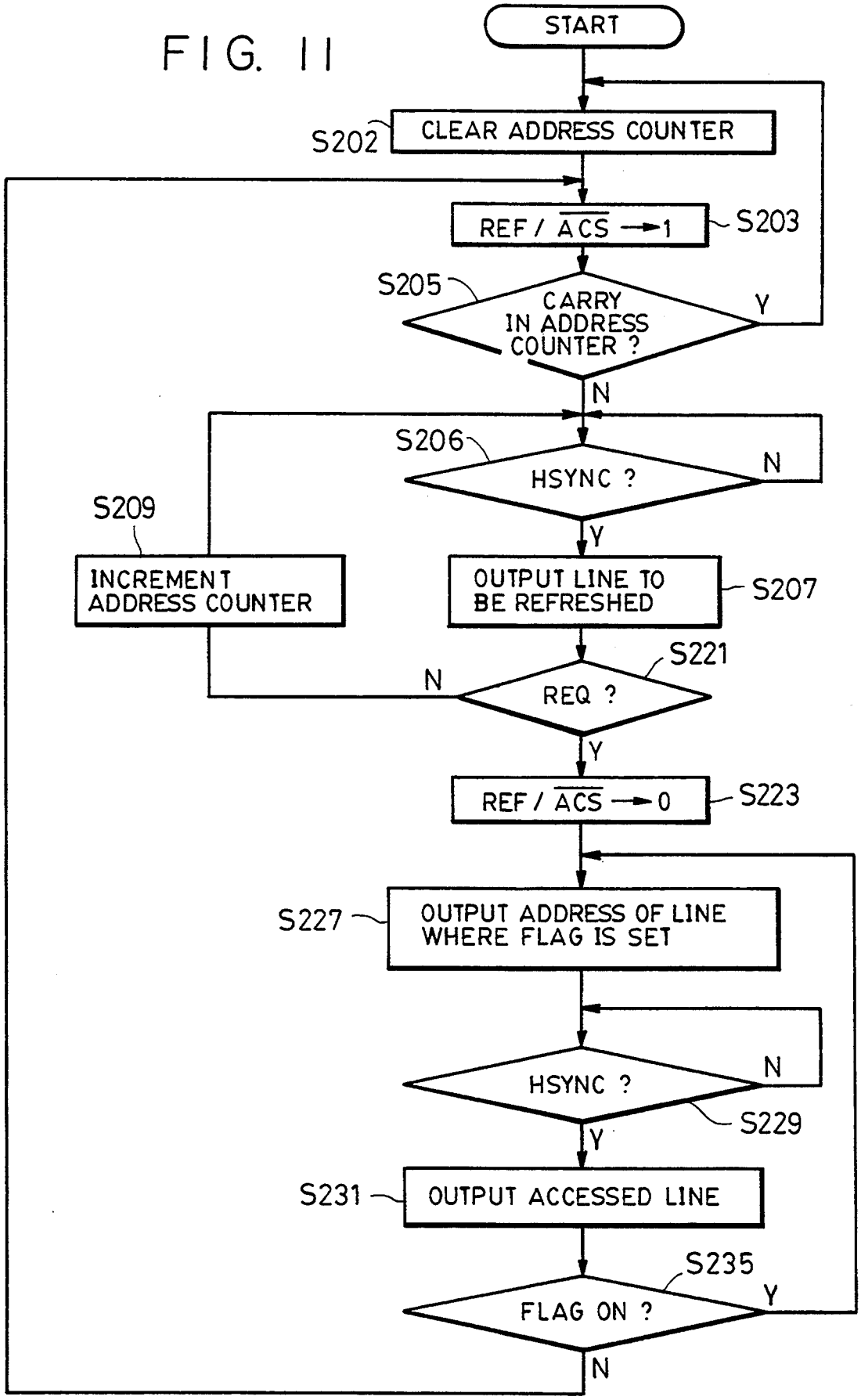
FIG. 11 is a flowchart showing a display operation procedure performed by respective units of the system shown in FIG. 2 when the configuration shown in FIG. 10(A) is adopted.
Figure 12:
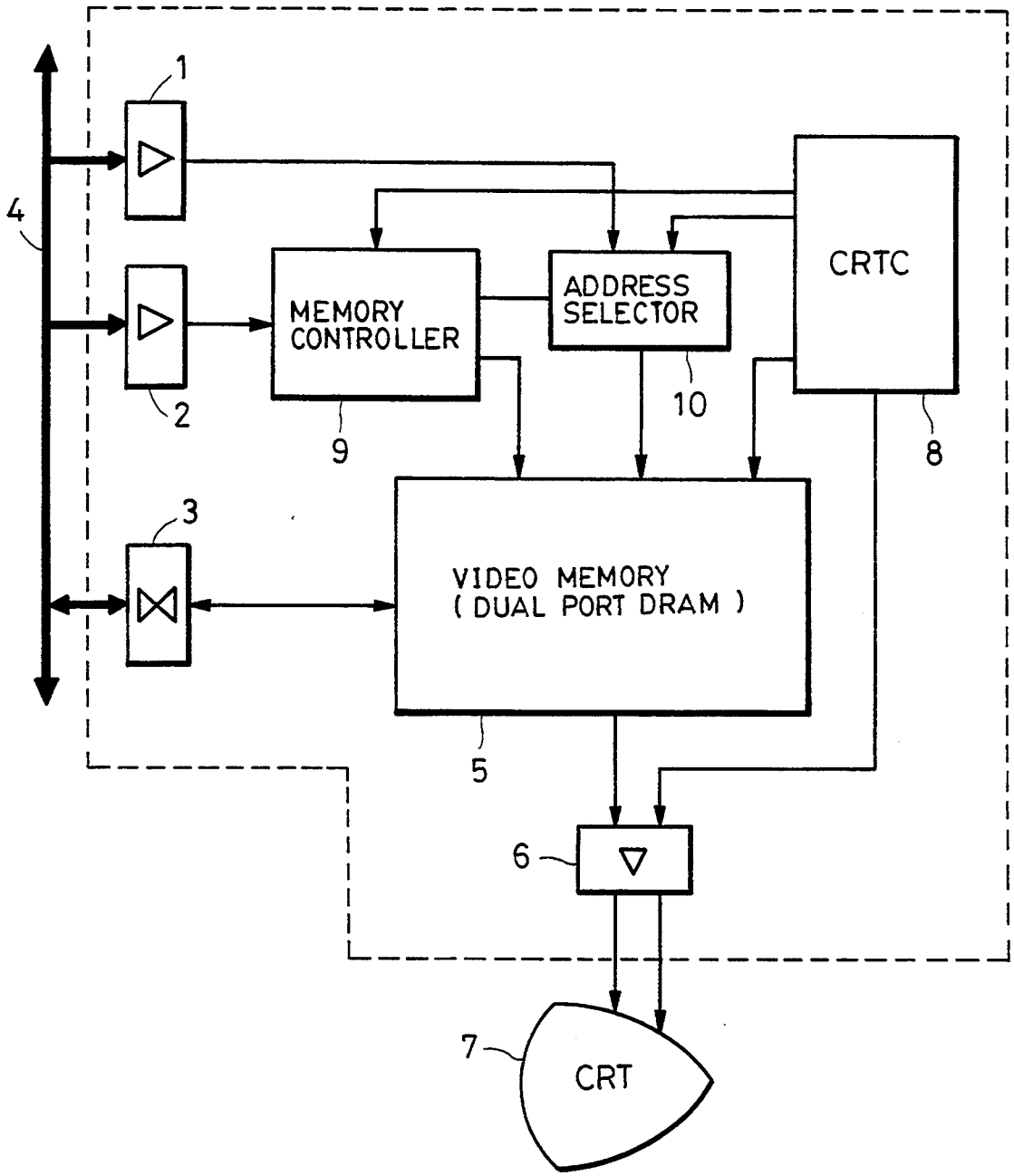
FIG. 12 is a block diagram showing the configuration of a conventional CRT interface.

FIG. 11 shows the operation procedure of the present embodiment. In FIG. 11, partial rewriting at any appropirate time is permitted. Since all the lines for which flags have been set are output, the values M and N have nothing to do with the operation. Accordingly, the line counter LN is not needed. Furthermore, in the present embodiment, the above-described step S221 is replaced by step S221' for determining the presence of the signal REQ, and the process proceeds to step S209 if the result of determination is negative.

By such an operation, priority is given to the partial rewriting cycle. It is desired in some cases, however, to give priority to the refreshing cycle according to temperature and the kind of an image. In such cases, for example, the number of lines to be output in the partial rewriting cycle may be limited, and partial rewriting may be resumed after refreshing at least one line (the number of lines may be variable).

As explained above, according to the present invention, a means for performing a cycle to rewrite a portion accessed from the side of a host machine, such as a CPU or the like, in a process to execute a cycle to sequentially rewrite the entire picture surface is provided, and conditions for shifting to the partial rewriting cycle are limited by the frequency of accesses. Hence, it is unnecessary to identify whether or not the current data are data to be partially rewritten in accordance with a command or the like from the CPU or the like, and it becomes possible to immediately display rewritten data without decreasing the refreshing rate.

Accordingly, it becomes also possible to make a display on the picture surface to follow the movement of a figure or a cursor with a high responsiveness without changing specifications of software and the like of a system using an FLC display, and therefore to perform an excellent display which fully utilizes the features of the FLC. Furthermore, compatibility between the CRT and the FLC as seen from the system can be maintained. Moreover, since the system can be realized with a simple circuit configuration, it becomes possible to perform an inexpensive and high-speed display control.

Second Embodiment

Figure 13A:
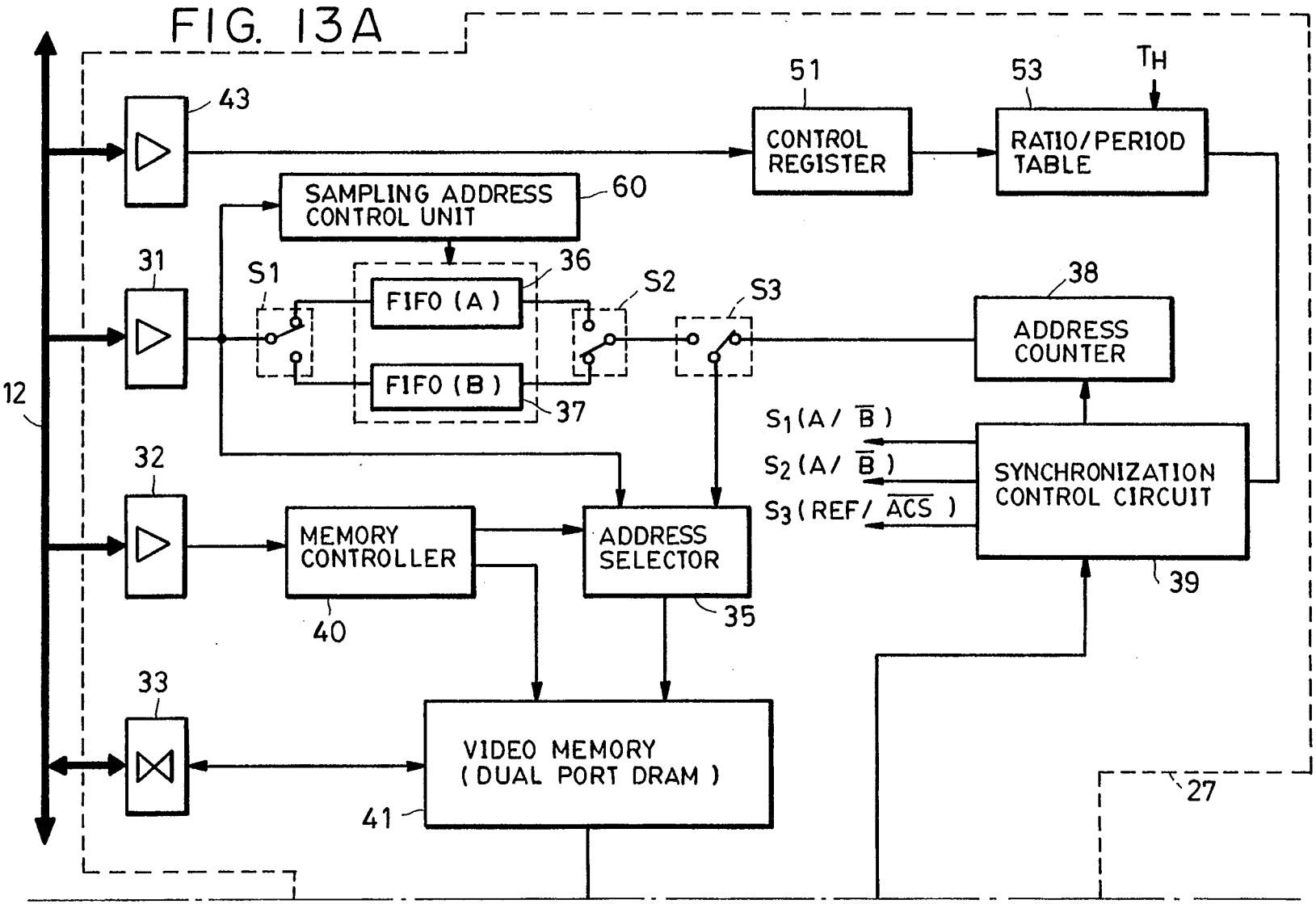
FIG. 13, composed of FIGS. 13A and 13B, is a block diagram showing the configuration of an FLCD interface according to another embodiment of the present invention.
Figures 13, 13B:
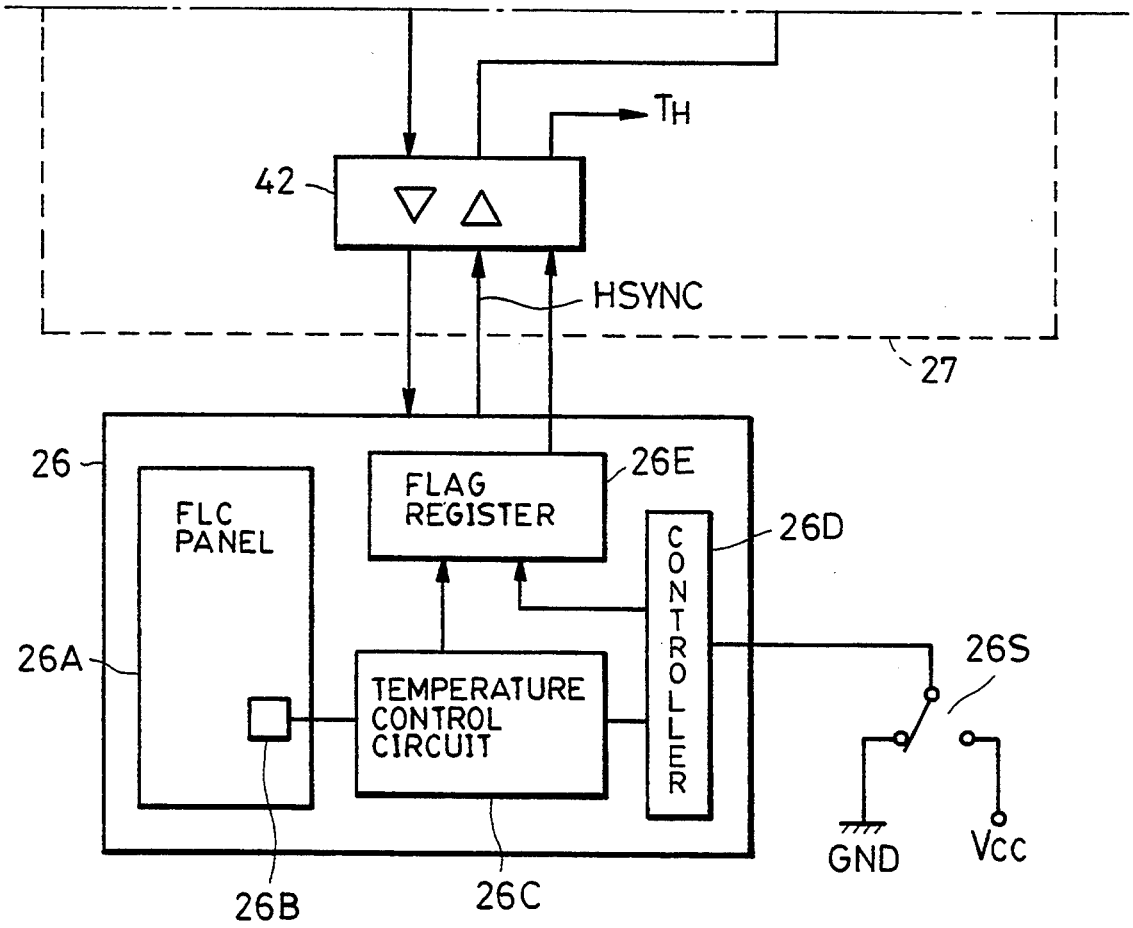

FIG. 13 is a block diagram showing an example of the configuration of the FLCD interface 27, serving as a display control device according to a second embodiment of the present invention. An explanation will now be provided by indicating like circuit configurations and signals as those in FIG. 2 by like numerals.

In FIG. 13, there are shown an address bus driver 31, a control bus driver 32, and data bus drivers 33 and 43. Address data from the CPU 11 are supplied from the address bus driver 31 to a memory controller 40 and one of two input ports of an address selector 35, and are selectively supplied to and stored in a memory 36 or 37 having the form of FIFO (first-in first-out) by switching a first switch S1. A control unit 60 controls sampling of the address data. If an address included on the same line reaches at least twice during one sampling period, the control unit 60 prohibits the storage of the address after the second time. These memories 36 and 37 (hereinafter termed a FIFO(A) and a FIFO(B), respectively) are FIFO memories which read data in the order of writing. Address data written in these memories 36 and 37 are selectively read by switching a second switch S2.

Address data read from the memory 36 or 37 and an address counter 38 (to be described later) are selectively input to another input port of the address selector 35 by switching a third switch S3. The address counter 38 generates address data for line sequentially refreshing the entire picture surface. The generation timing of the address data is controlled by a synchronization control circuit 39. The synchronization control circuit 39 also generates switching control signals for the switches S1, S2 and S3 and a data transfer request signal for a memory controller 34.

A control signal from the CPU 11 is supplied from the control bus driver 32 to thee memory controller 40, which generates a control signal for the address selector 35 and a control signal for a video memory 41 (to be described later). The address selector 35 selects one of the two address data input to the input ports of the address selector 35 according to the control signal from the memory controller 40, and supplies the video memory 41 with the selected address data.

The video memory 41, comprising a dual-port DRAM (dynamic random access memory), stores display data, and performs writing and reading of display data via the data bus driver 33. Display data written in the video memory 41 are transferred to the FLCD 28 via a driver/receiver 42, and are displayed on the FLCD 26. The driver/receiver 42 supplies the synchronization control circuit 39 with a synchronizing signal from the FLCD 26.

Data for setting the ratio between the number of lines to be partially rewritten and the numer of lines to be subjected to refreshing driving, and the like in accordance with the kind of an image, and the like are supplied to a control register 51 via the data bus driver 43.

A temperature sensor 26B is provided at an FLC panel 26A of the FLCD 26 in order to detect the temperature thereof. A temperature control circuit 26C performs the temperature control of the FLC panel 26A which uses a heater or the like according to a temperature detected by the temperature sensor 26B. The temperature control circuit 26C also sets the value of a flag in a flag register 26E referring to a table, which will be described later with reference to FIG. 5, according to the detected temperature. A controller 26D for controlling the FLCD 26 is provided, for example, on the case of the FLCD 26, and switches the above-described referred table in accordance with a state of a temperature-table switching switch 26S operable by the user. By providing a table in accordance with the switch 26S, it is possible to reduce the number of flags, and to simplify the configuration of hardware. A variable resistor may be provided in place of the above-described switch, and a plurality of tables may be provided in accordance with the value of the variable resistor.

A ratio/period setting unit 53 may include a memory storing a table for selecting driving conditions (the ratio between the refreshing cycle and the partially rewriting cycle (to be described later) and the repetition periods of the respective cycles) of the FLC panel 26A in accordance with information relating to the kind of an image and the like stored in the control register 51 and information (a temperature flag) relating to the detected temperature. A ROM may be used as the memory if it is not assumed to rewrite the contents of the table from the system side, and a RAM may be used if it is assumed to rewrite the contents of the table. It is possible to control the operation of the synchronization control circuit 39 to properly drive the FLC panel 26A in accordance with the table.

In the above-described configuration, when the CPU 11 changes a display, an address signal for the video memory 41 corresponding to rewriting of desired data is supplied to the memory controller 40 via the address bus driver 31, where arbitration between a memory access request signal from the CPU 11 and a data trasfer request signal from the synchronization control circuit 39 is performed. If the CPU access side obtains right, the memory controller 40 switches the address selector 35 so as to select the address accessed by the CPU 11 as an address to be provided for the video memory 41. At the same time, the memory controller 40 generates a control signal for the video memory 41, and reading/writing of data is performed via the data bus driver 33. At that time, the CPU-accessed address is stored in the FIFO(A) 36 or the FIFO(B) 37, and is utilized when transferring display data (to be described later). As described above, the method of accessing display data from the CPU 11 is entirely the same as in the above-described case for the CRT.

When reading data from the video memory 41 and transferring the read data to the FLCD 26, a data transfer request signal is generated by the synchronization control circuit 39 and is transmitted to the memory controller 40. An address at the side of the address counter 38 or the FIFO is selected as the address for the video memory 41 by the address selector 35, and a control signal for data transfer is generated by the memory controller 40. Data of the proper address are transferred from the memory cell to the shift register, and are output to the driver 42 by a serial-port control signal.

The synchronization control circuit 39 generates timings for generating cycles to line-sequentially totally refreshing the picture surface in units of a plurality of lines according to a horizontal synchronizing signal HSYNC from the FLCD 26, and partially rewriting cycles to rewrite lines accessed by the CPU 11. In the totally refreshing cycles, rewriting is sequentially performed from the uppermost line (the leading line) on the display picture surface to the lower lines. When rewriting has been performed until the lowest line, rewriting is repeated with returning to the leading line. In rewriting cycles of accessed lines (partially rewriting cycles), lines accessed by the CPU 11 within a predetermined time period immediately before the cycle are rewritten.

As described above, in the second embodiment, basically, the operation of sequentially refreshing the entire picture surface of the FLCD 26 and the operation of rewriting lines accessed by the CPU11 in order to change the contents of display are alternately performed using time division. In addition, the repetition period of these operations and the ratio in time between these operations within one period may be set in accordance with the kind of image data, temperature conditions and the like.

Figure 14:
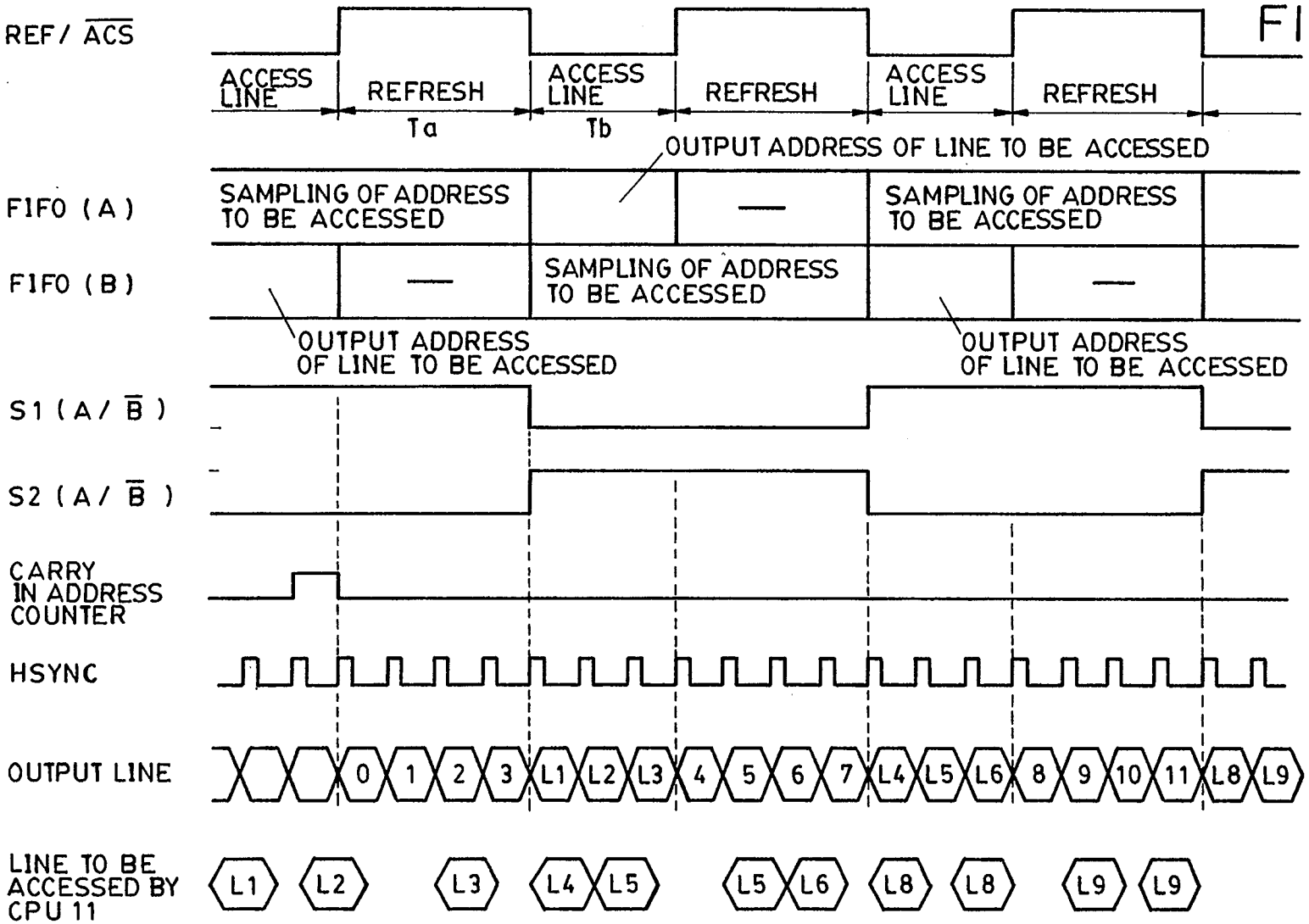
FIG. 14 is a timing chart illustrating the basic operation of the FLCD interface shown in FIG. 13.

First, an explanation will be provided of the basic operation of the second embodiment wherein the refreshing operation and the line-rewriting operation are alternately performed with reference to FIG. 14. FIG. 14 show a case wherein the refreshing cycles are performed in units of 4 lines, and the rewriting cycles are performed in units of 3 lines.

In FIG. 14, REF/$\overline{\text{ACS}}$ represents timings to generate entire-surface refreshing cycles and rewriting cycles for accessed lines. Level "1" indicates cycles for total refreshing cycles, and level "0" indicates cycles for rewriting cycles for accessed lines. Symbol $T_a$ represents the time of an entire-surface refreshing cycle, and symbol $T_b$ represents the time of a rewriting cycle of accessed lines. In this example, it is assumed that $T_a$:$T_b$=4:3, but this rate may be selected to have an optimim value according to the requested refreshing rate and the like. That is, the refreshing rate can be increased by increasing the ratio of $T_a$, and the responsiveness for a partial change can be improved by increasing the ratio of $T_b$. This processing will be described later.

An explanation will now be provided of the states of the FIFO(A) 36 and the FIFO(B) 37. If the switch S1 is connected to the side of the FIFO(A) 36 (the state A/$\overline{\text{B}}$=1), the addresss of lines to be accessed by the CPU 11 are sampled by and stored in the FIFO(A) 36. On the other hand, if the switch S1 is connected to the side of the FIFO(B) 37 (A/$\overline{\text{B}}$=0), the addresses of lines to be accessed by the CPU 11 are stored in the FIFO(B) 37. If time switch S2 is connected to the side of the FIFO(A) 36 (A/$\overline{\text{B}}$=1), the addresses stored in the FIFO(A) 36 are output. If the switch S2 is connected to the side of the FIFO(B) 37, the addresses stored in the FIFO(B) 37 are output.

When one refreshing cycle of the entire picture surface has been completed, and the FLCD 26 has output a vertical synchronizing signal VSYNC or when a carry has been generated in the address counter 38, the address counter 38 is cleared, the line to be output in the next entire-surface refreshing cycle is returned to the 0-th line, and lines are sequentially counted up as "1", "2", "3", . . . for every horizontal synchronizing signal (HSYNC) provided from the FLCD 26 via the synchronization control circuit 39. If the addresses of unoverlapped lines L1, L2 and L3 are accessed by the CPU 11 during this period, the addresses of lines L1, L2 and L3 are stored since the switch S1 is connected to the FIFO(A) 36. Subsequently, when the switch S2 has been connected to the FIFO(A) 36, the addresses of lines L1, L2 and L3 are output from the FIFO(A) 36, and lines L1, L2 and L3 are selected as output lines. A switching signal for the switch S3 is supplied as REF/$\overline{\text{ACS}}$ from the synchronization control circuit 39. The switch S3 is switched to the side of the FIFO(A) and the FIFO(B) for output line addresses in line accessing cycles.

At that time, since the switch S1 is connected to the side of the FIFO(B) 37, access addresses are stored in the FIFO(B) 37. When REF/$\overline{\text{ACS}}$ has become "1", the switch S3 is switched to the side of the address counter 38, and a refreshing operation is performed from the line succeeding the line at the preceding cycle. In FIG. 14, lines "4", "5", "6" and "7" which succeed the output of line L3 at the preceding cycle are output. Subsequently, the above-described operation is repeated in the same manner. Two FIFOs are provided in order to consistently and efficiently sample memory-accessed addresses, and at the same time output the sampled addresses. That is, the sampling period of addresses is from starting to output accessed lines in one of the FIFOs to the end of an entire-surface refreshing cycle. After the end of the entire-surface refreshing cycle, a rewriting cycle of accessed lines wherein addresses sampled during the immediately preceding sampling period starts, and at the same time the sampling period for addresses in the other FIFO starts.

When the same line has been accessed at least twice during one sampling period, a sampling address control unit 60 prohibits the storage of address data after the second time in the FIFOs. That is, for example in FIG. 14, the CPU 11 accesses lines L4, L5, L5 and L6 while the FIFO(B) 37 performs sampling, wherein access to line L5 is overlapped. Hence, the addresses of lines L4, L5 and L6 are finally stored in the FIFO(B) 67 without being overlapped. To the contrary, if the sampling address control unit 60 is not provided, the address of line L5 is stored with being overlapped. Accordingly, in such a case, if the number of output lines at the partial rewriting cycle is "3" as in the example shown in FIG. 14, line L6 is not instantaneously rewritten since the address of line L5 has been stored with being overlapped. In the present embodiment, however, lines L4, L5 and L6 are instantaneously rewritten at the next partial rewriting cycle. Furthermore, in the present embodiment, since it is possible to efficiently store the addresses of lines in the FIFOs, the capacity of the FIFOs may be small.

Figure 15:
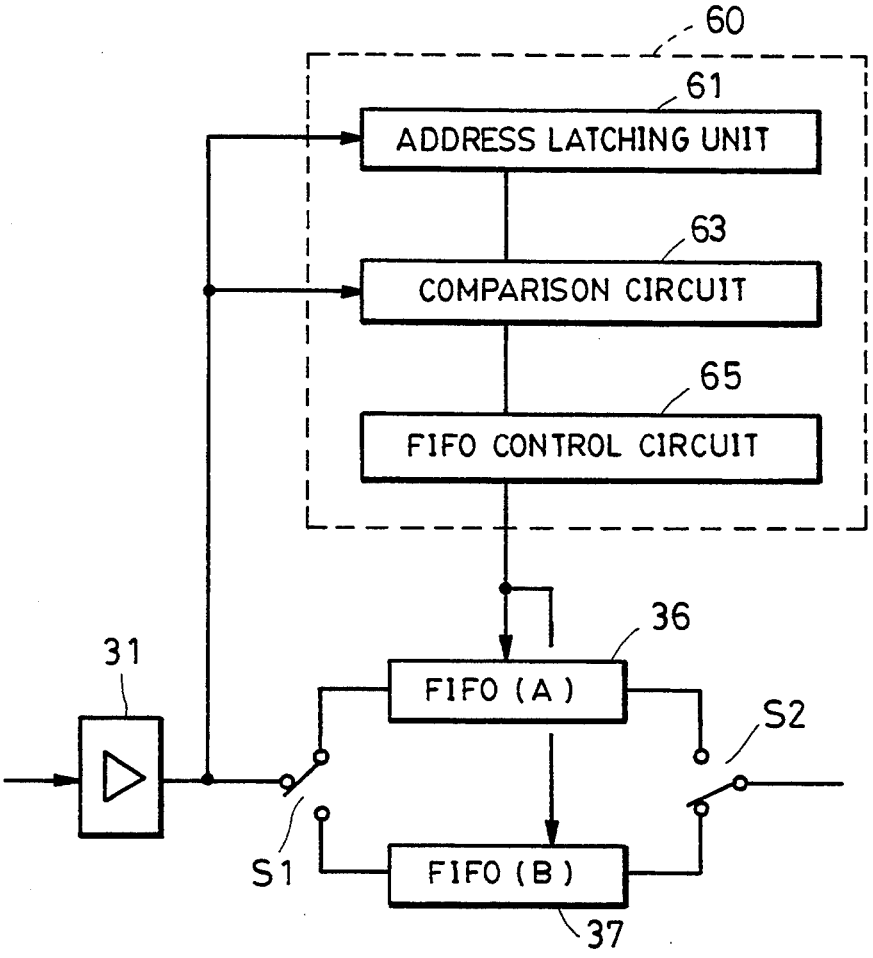
FIG. 15(A) is a block diagram showing an example of the configuration of a sampling address control unit shown in FIG. 13.
FIG. 15(B) is a flowchart illustrating an operation of the sampling address control unit shown in FIG. 15(A)
Figure 15:
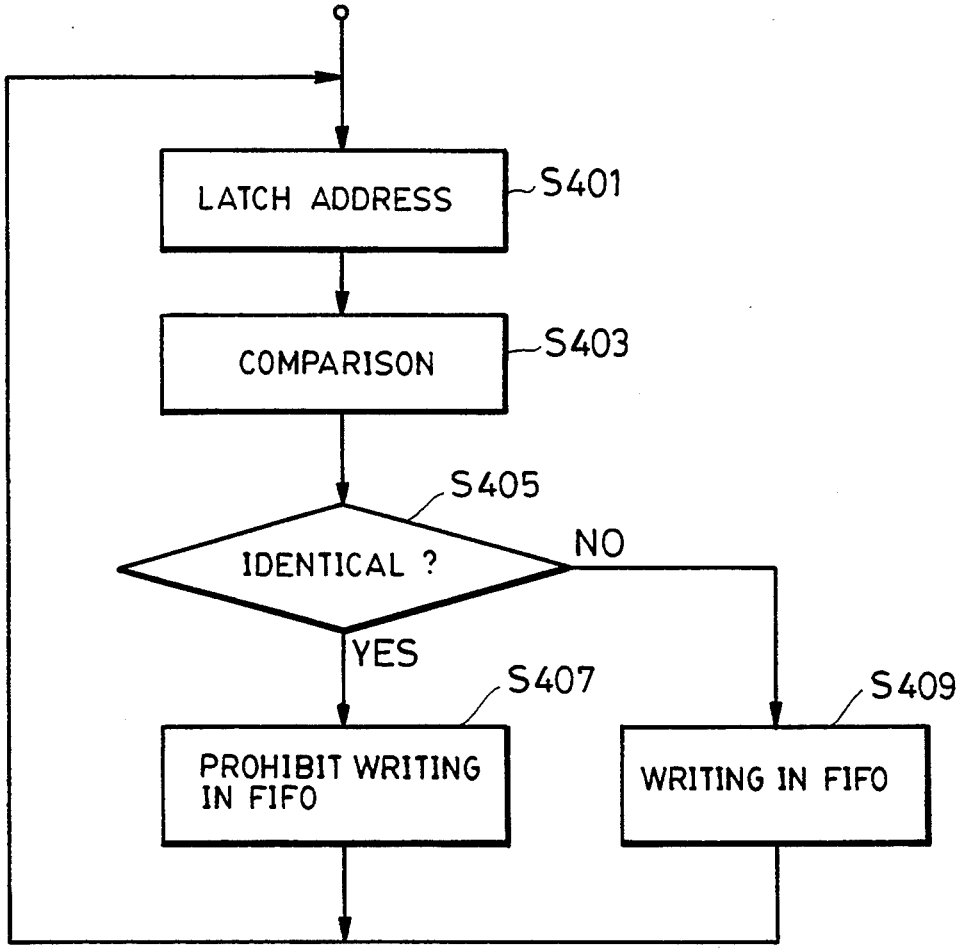

FIGS. 15(A) and 15(B) show an example of the configuration and an operation of the sampling address control unit 60. In FIGS. 15(A) and 15(B), a latching unit 61 latches an input address (processing at step S401). A comparison circuit 63 compares the input address with a latched address (processing at step S403), and determines whether or not the two addresses coincide (processing at step S405). A control circuit 65 generates a signal for prohibiting the storage of the address in the FIFO(A) 36 or the FIFO(B) 37 (step S407) performing a sampling operation according to a coincidence signal from the comparison circuit 8S, and for executing the storage (step S409) when the two addresses do not coincide.

According to such a configuration, it is possible to hinder storage of the same address in units of a line, therefore to omit wasteful storage of an overlapped address, to provide small FIFOs, and to prevent the generation of lines which cannot be instantaneously rewritten, as shown in FIG. 14.

Assuming a case wherein an overlapped address is not continuously transmitted, but is transmitted as, for example, L4, L5, L6 and L5, address latching units may be configured in a plurality of stages, and the current address may be compared with an already-latched address.

In the basic operation of the present embodiment, the refreshing cycle and the line-rewriting cycle are alternately repeated, and the repetition period corresponds to 7 lines with $T_a$:$T_b$=4:3. However, the ratio between $T_a$ and $T_b$ may be changed according to a refreshing rate and the like requested in accordance with environmental conditions, such as temperature and the like, the kind of data to be displayed, a difference in the display-device material for the FLCD, and the like. That is, by increasing the ratio of $T_a$ (corresponding to the number M of lines within one refreshing cycle, that is, $T_a$=M×(the period of HSYNC)), the refreshing rate can be increased, providing an excellent display state even if the responsiveness of the FLCD is low, for example, at a low temperature or the like, or an image is displayed. On the contrary, by increasing the ratio of $T_b$ (corresponding to the number N of lines within one partial rewriting cycle, that is, $T_b$=N×(the period of HSYNC)), the responsiveness in a partial change of display can be increased. Hence, it is possible to deal with a case wherein a high refreshing rate is not needed, for example, at a high temperature, in displaying characters, or the like.

In the second embodiment, the number of lines corresponding to the repetition period may be set. Thus, the ratio between the refreshing cycle and the partial rewriting cycle may be changed in a finer manner to be optimized in a finer manner. For example, when priority must be or is preferred to be given to the refreshing rate, if the number of lines corresponding to the repetition period is set to 40, and $T_a$:$T_b$=4:1, it is possible to perform entire-surface refreshing for 32 lines, and to perform rewriting of accessed lines for 8 lines. When priority must be or is preferred to be given to partial rewriting, if the number of lines corresponding to the repetition period is set to 10, and $T_a$:$T_b$=3:2, it is possible to perform entire-surface refreshing for 6 lines, and to perform rewriting of accessed lines for 4 lines.

Also in the second embodiment, as shown in FIG. 6, the setting unit 53 has a table storing respective value M (the number of lines within one refreshing cycle) and value N (the number of lines within one partial rewriting cycle) in accordance with a combination of header information H1, H2, . . . , HY indicating the kind of an image, and information $T_H$1, $T_h$2, . . . , $T_H$X (four kinds in the present embodiment) corresponding to the temperature flag.

Accordingly, during a display control operation (FIG. 16), certain values M and N are read in accordance with the header information H and the temperature information $T_H$ at that time period. In accordance with the read values, a counter (not shown) in the synchronization control circuit 39 counts synchronizing signals HSYNC, and outputs a signal REF/ACS. By such a combination of the values M and N, the repetition period (=(M+N)×(the period of HSYNC)) and the ratio ($T_a$:$T_b$=M:N) are determined.

FIGS. 8(A)–8(D) may also be applied to the second embodiment. That is, FIGS. 8(A)–8(C) are flowcharts showing control procedures by the CPU 11 accompanying the operation of the user in the information processing system shown in FIG. 1 according to the embodiment of the present invention. FIG. 8(D) is a flowchart showing an operation procedure of the FLCD 27 in accordance with the above-described control procedures.

FIG. 8(A) shows a control procedure in an image input mode by the scanner 21B, and when displaying the input data on the FLCD 26. At step S501, a scanner icon on the display picture surface of the FLCD 26 is selected, for example, by the operation of the mouse 24 by the user. At step S502, a window for displaying an input image on a predetermined portion of the display picture surface is opened. At step S503, the user sets an input mode from among character, photograph and fine photograph modes in accordance with the image input by the scanner 21B. At step S504, header information as described with reference to FIG. 4 is selected in default from among a plurality of predetermined header values, and the selected information is added. At the same time, at step S505, the header information is set in an image data header register 44A shown in FIG. 2.

Subsequently, at step S506, the input operation by the scanner 21B is started. At step S507, input image data are first stored in the main memory 13 in order to adjust resolution between the scanner 21B and the FLCD 26. Subsequently, at step S508, the image data are expanded in the video memory 41, and are displayed.

Subsequently, at step S509, it is determined whether or not the user has changed the display state by operating, for example, a control symbol displayed on the display picture surface using a mouse or the like in order to change the display picture quality. If the result of determination is affirmative, at step S510, another header value is selected from among the above-described plurality of header values in accordance with the change. At step S511, the header information is set in the control register 51. If the result of determination at step S509 is negative, the processing is terminated.

FIG. 8(B) showns a control procedure in a character input mode corresponding to a word processor. If the present processing is started, for example, by a predetermined key operation on the keyboard 23, paper for input is displayed on a predetermined portion of the display picture surface. At step S522, a predetermined header value is selected in default from among the above-described plurality of header values, and the selected header value is added to a predetermined area in the memory. At step S523, the header value is set in the control register 51.

Subsequently, at step S524, key input is performed. At step S525, key input data are expanded in the video memory 41, and are displayed.

Subsequently, at step S526, it is determined whether or not the user has changed the display state, in the same manner as in the control procedure shown in FIG. 8(A). If the result of determination is affirmative, the header value is changed at step S527. The process then returns to step S523, where the header value is set in the register 44A in order to change the display. If the result of determination at step S526 is negative, it is determined whether or not the key input has ended at step S528. If the result of determination is affirmative, the present processing is terminated. If the result of determination is negative, the process returns to step S524.

FIG. 8(C) shows the control procedure of a file display mode for displaying a file stored in the hard disk 18 or the floppy disk 19.

When the present processing has been started, header information for the file is read at step S531. At step S532, header information added to the file is set in the control register 51. Subsequently, at step S533, data within the file are stored in the memory 13 in order to perform the above-described adjustment of resolution and the like. At step S534, these data are expanded in the video memory 41, and are displayed. At steps S535–S537, the same processing as the processing at steps S509–S511 shown in FIG. 8(A) is performed.

FIG. 8(D) shows the operation of the FLCD interface 27 corresponding to respective control procedures shown in FIGS. 8(A)–8(C).

That is, if there has been any change in the contents of the control register 51 at step S541, or temperature has changed, the FLCD interface 27 receives an input or inputs of the value H and/or the value $T_H$ which changed at step S542. At step S543, the values M and N are reset. Accordingly, at step S544, the operation of the synchronization control circuit 39 in accordance with the values M and N is performed.

Figure 16:
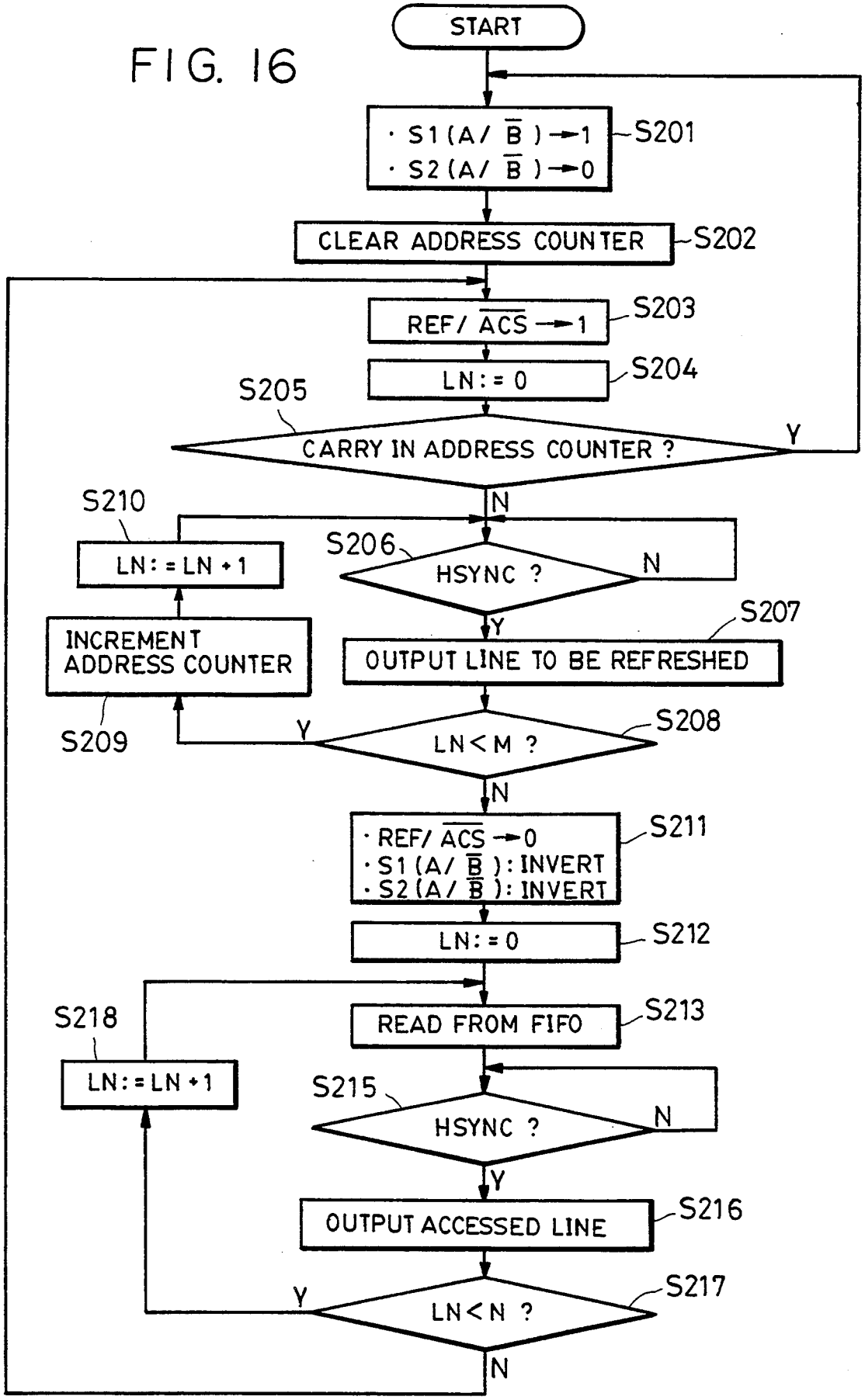
FIG. 16 is a flowchart showing a display operation procedure performed by respective units of the device shown in FIG. 13.

FIG. 16 illustrates a display operation procedure performed by respective units shown in FIG. 2

First, at step S201, initial states of the switches S1 and S2 are set. Although, in the present embodiment, the switch S1 is switched to the side of the FIFO(A) 36, and the switch S2 is switched to the side of the FIFO(b) 37, the process may start from any side, provided that the side to start is fixed. At step S202, the address counter 38 is cleared, and its refreshing address is set to an initial value, for example, "0". Subsequently, at step S203, REF/$\overline{ACS}$ is set to "1" so that the entire-surface refreshing cycle is performed. The counter for counting the number of transferred lines within one refreshing or partial rewriting cycle (one refreshing cycle in this case) is cleared to set the count value LN to "0".

Subsequently, at step S205, it is determined whether or not the current status is during a period (a flyback period) wherein the refreshing has been completed until the last line and a carry is generated in the address counter. If the result of determination is affirmative, the process returns to step S201. If the result of determination is negative, at step S206, the arrival of a signal HSYNC is awaited. If a signal HSYNC has arrived, data of lines indicated by refreshing-line addresses are transferred to the FLCD 26. At step S208, it is determined whether or not the number M of lines (set by the setting unit 53) to be transferred by one entire-surface refreshing cycle has been cleared. If the count value LN is less than the number M, the process proceeds to step S209, where the address counter 38 is counted up. At step S210, the value LN is incremented by one, and the process returns to step S206. This processing is repeated until M lines are tranferred. Since M=4 in the case shown in FIGS. 3(A) and 3(B), the loop from step S206 to step S210 is repeated four times.

When the transfer of M lines has been completed, at step S211, REF/$\overline{ACS}$ is set to "0" in order to rewrite accessed lines. Furthermore, the connection states of the switches S1 and S2 are reversed to reverse the role of the address sampling and line address output of the FIFOs. Subsequently, at step S212, the count value LN is again set to "0" in order to count the number of transferred lines during the rewriting operation of the accessed lines. At step S213, addresses sampled from either one of the FIFO(A) 36 or the FIFO(b) 37 are read.

At step S215, the arrival of the signal HSYNC is awaited. When the signal HSYNC has arrived, data of the address of the line output at step S216 are transferred to the FLCD 26. Subsequently, at step S217, it is determined whether or not the transfer of lines has been completed for N (set by the setting unit 53) lines. If the count value LN is less than the value N, the process proceeds to step S218, where the value LN is incremented by one. The process then returns to S213. This processing is repeated until the transfer of N lines is completed. When N=4, the loop from step S213 to step S218 is repeated four times. When the transfer of N lines has been completed, the process returns again to step S203 in order to resume the entire-surface refreshing cycle.

As described above, the display of the contents of the video memory 41 is performed by repeating the entire-surface refreshing cycle from step S203 to step S208, and the rewriting cycle of accessed lines from step S211 to step S217, returning the line for the entire-surface refreshing cycle to the leading line when a carry has been generated in the address counter 37, and initializing the signal. On the other hand, in order to obtain the displayed contents, the CPU 11 may read data from and write data in the video memory 41 independently of the above,described display operation.

As described above, reading of data from the video memory 41 and transfer of the read data to the FLCD 26 do not require command interpretation, can be configured by relatively simple circuitry, and can be realized with a lower cost than performing display control by executing command interpretation with providing a graphic processor and the like. Hence, it is possible to improve the performance while reducing the cost of the entire system.

The present invention is not limited to the above-described embodiment, but various changes and modifications may of course be made within the true spirit and scope of the present invention.

For example, within the range of the number of lines subjected to partial rewriting set as in the above-described embodiment, the number P of lines subject to actual partial rewriting during a refreshing cycle may be adjusted in accordance with the number of lines accessed by the CPU 11 and the status of line access. Thus, by dynamically adjusting time $T_b$ in accordance with the number of lines accessed by the CPU 11, it is possible it omit useless line rewriting cycles when lines are hardly addressed by the CPU 11 to increase a refreshing rate, and hence to dynamically optimize the relationship between the follow-up capability of the operation and the refreshing rate.

Although, in the foregoing embodiment, the repetition frequency, and the ratio between the refreshing cycle and the partial rewriting cycle are set during the operation period according to temperature information and the kind of an image, the timing of the setting may be appropriately determined. For example, the setting may be performed during a flyback period. Furthermore, in addition to temperature information, other environmental conditions may be considered. If there is no problem, the setting may be performed according to either one of environmental conditions, such as temperature information and the like, and the kind of an image.

The configuration of the sampling address control unit 60 for prohibiting the storage of an overlapped address in the FIFOs transmitted during one sampling period is not limited to that shown in FIG. 4(A), but may be appropriately adopted. For example, when trying to display a character string on a column comprising a plurality of continuous lines, the CPU 11 in some cases continuously and repeatedly accesses the plurality of lines (for example, lines L16–L31).

Figure 17:
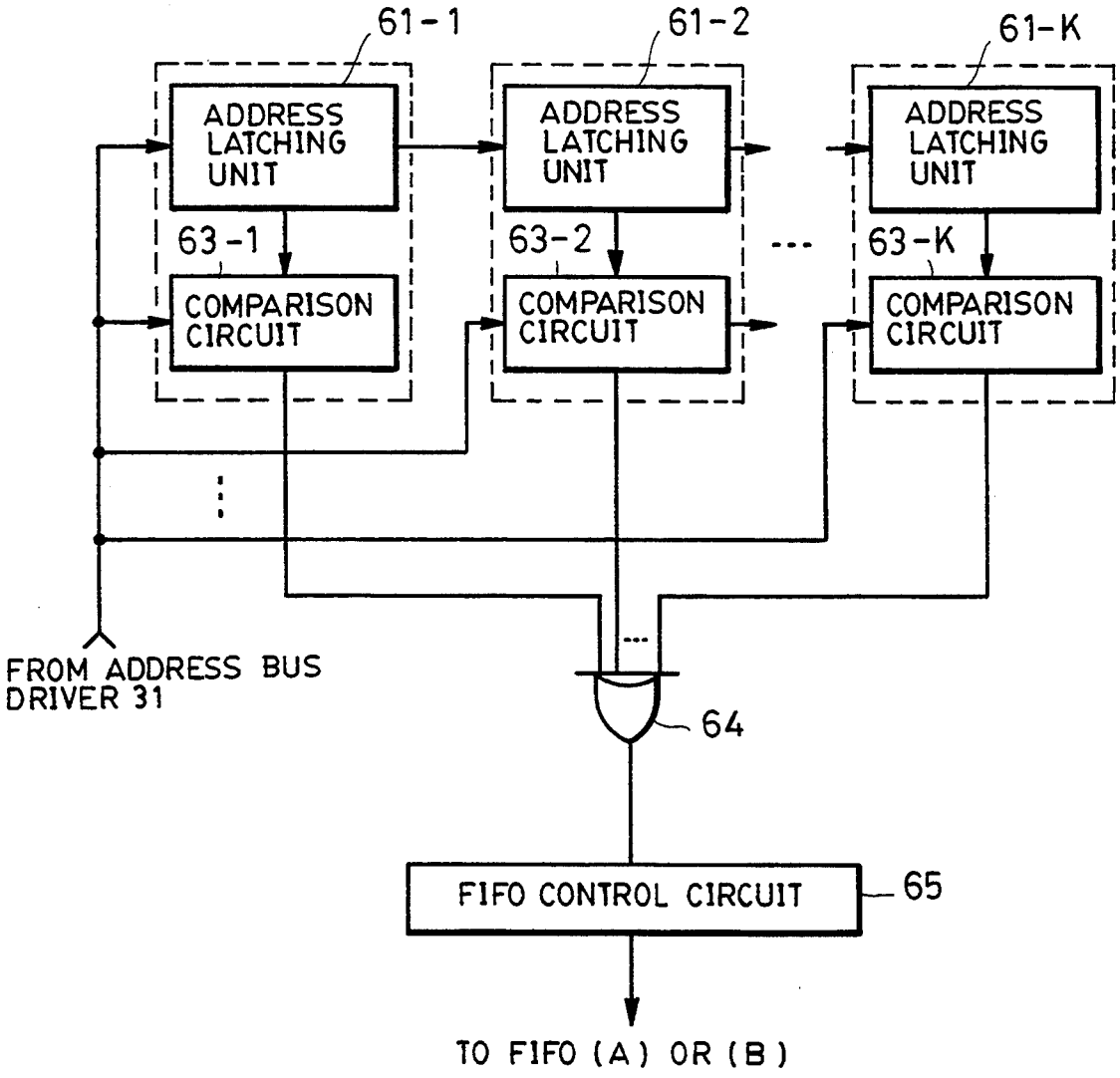
FIGS. 17, 18 and 19 are block diagrams showing other examples of the configuration of the sampling address control unit shown in FIG. 13.

FIG. 17 shows an example of the configuration of the sampling address control unit for dealing with such cases. In FIG. 17, address latching units 61-1, 61-2, . . . , 61-K comprise shift registers provided in a plurality of stages (K stages), and shift the latched contents every time address data are input. Comparison circuits 63-1, 63-2, . . . , 63-K are combined with the address latching units 61-1, 61-2, . . . , 61-K, respectively. Each comparison circuit compares an input address with the contents stored in the corresponding address latching unit, and outputs a coincidence signal when the two values coincide. An OR circuit 64 receives output signals from the comparison circuits 63-1–63-K. A FIFO control circuit 65 controls a writing operation of address data in the FIFO(A) 36 or the FIFO(B) 37 in accordance with an output from the OR circuit 64.

In such a configuration, when the CPU 11 sequentially accesses a plurality of continuous lines and repeats the access, none of the comparison circuits output coincidence signals since the addresses of the plurality of lines do not overlap at the first sequential access. Hence, these addresses are written in the FIFO. In the sequential access after the second time, however, since one of the comparison circuits outputs a coincidence signal, the coincidence signal is supplied to the FIFO control circuit 65 via the OR circuit 64, and so writing of the address in the FIFO is prohibited. It is thereby possible to efficiently use the FIFOs.

The above-described number K of stages may be appropriately determined. Within that range, overlapped sampling in sequential and repeated access of a plurality of lines is prevented.

Figure 18:
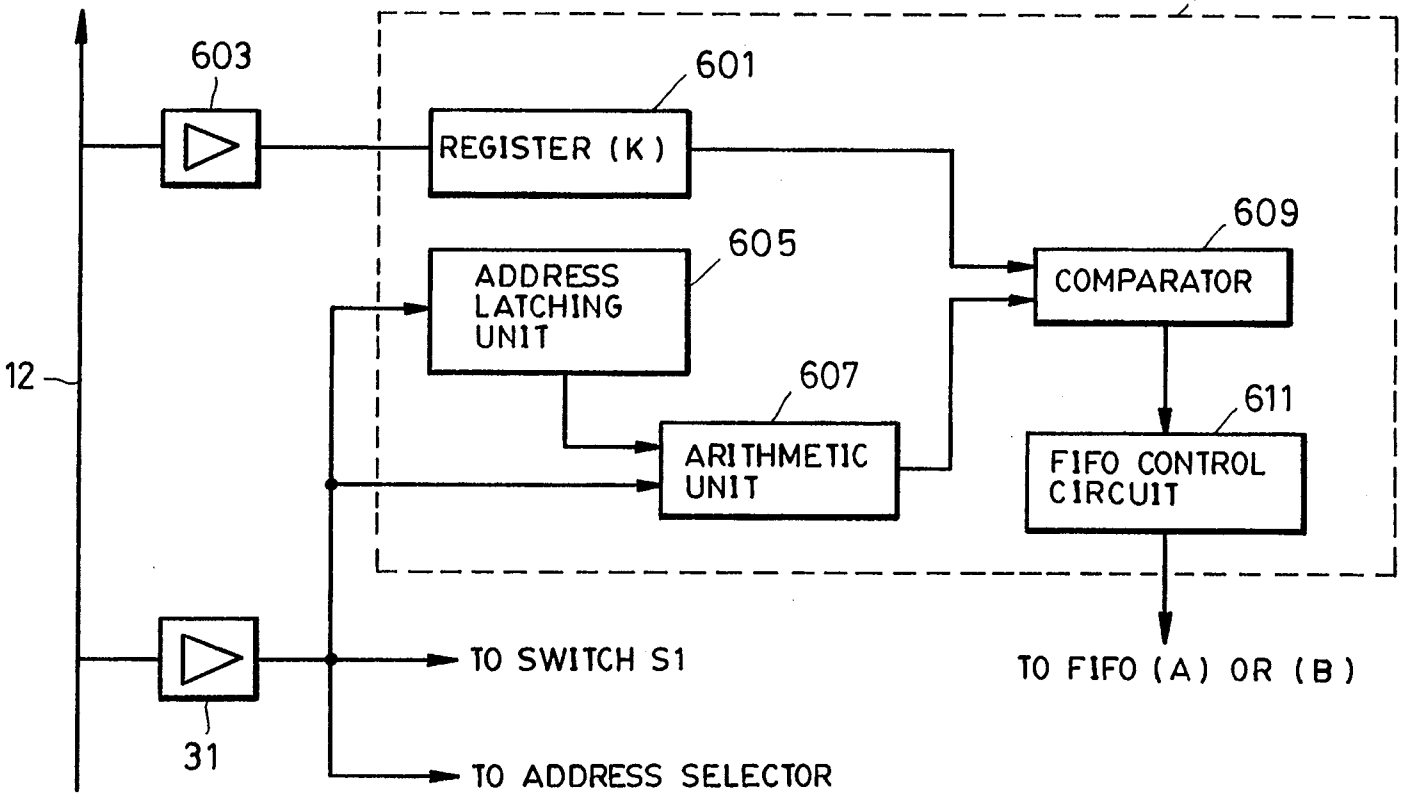

FIG. 18 shows another example of the configuration of the sampling address control circuit 60. In the present embodiment, the value K may be set, and the addresses of accessed lines within ±K lines from the existing address are prohibited to be stored in the FIFO. In FIG. 18, the CPU 11 sets the value K in a register 601 via a data bus driver 603. An address latching unit 605 latches, for example, address data which have first arrived during one sampling period. An arithmetic unit 607 calculates the difference between the current address and an address which arrives after the next time. A comparator 609 compares the current arithmetic output with the value K set in the register 601. If the arithmetic output is less than K, the comparator 609 outputs a signal indicating this fact to prohibit a writing operation in the FIFO via a FIFO control circuit 611.

The value K is appropriately set by the CPU 11. It may, for example, be set to "16" when displaying characters comprising 16 bits (characters expanded on 16 lines). When displaying an image, the value K may, for example, be set to "1".

In the second embodiment, when partially rewriting the FLCD 26, if the set number K of lines is made a unit, and display is performed, for example, by simultaneously driving ±K lines around the line stored in the FIFO, the omission of accessed lines can be prevented. If data, such as the height of characters and the like, are added to the header information shown in FIG. 5, and such data are also stored in the control register 51 shown in FIG. 2, the register 601 may not be provided.

Figure 19:
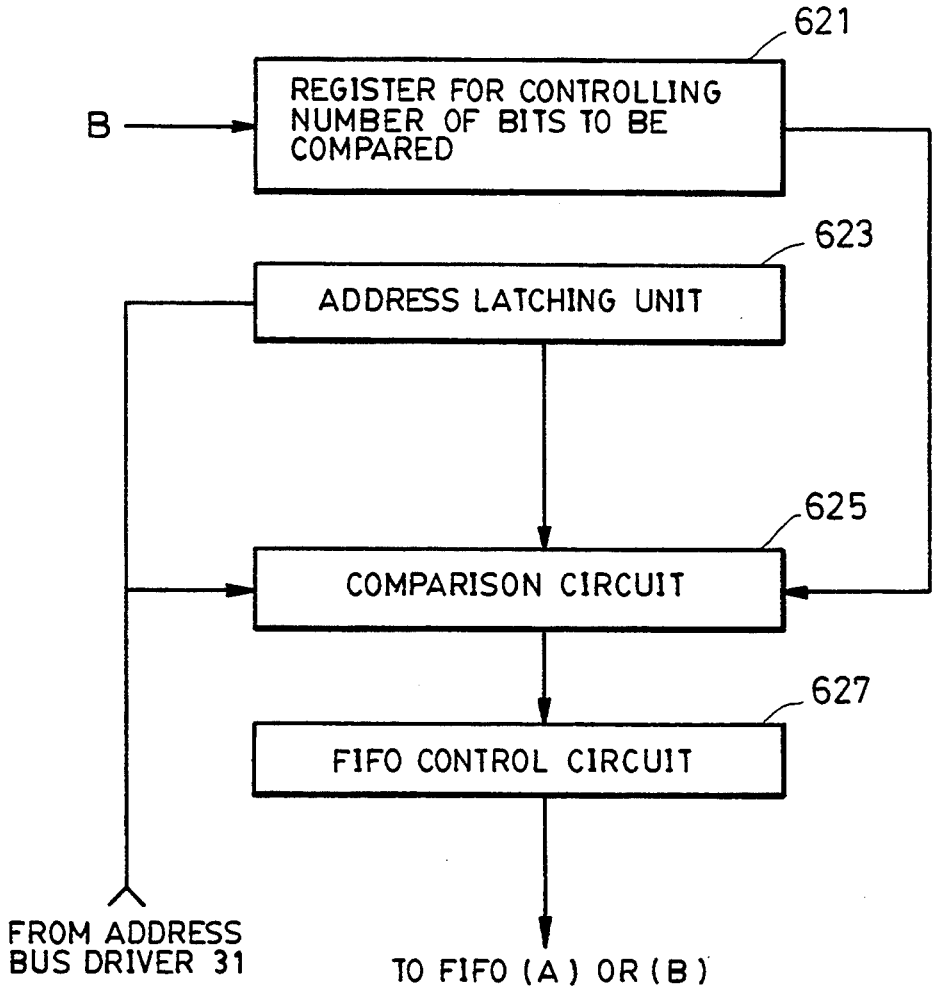

FIG. 19 is still another example of the configuration of the sampling address control circuit 60. In FIG. 19, a register 621 controls the number of bits to be compared between addresses. There is also shown an address latching unit 623. A comparison circuit 625 compares an input address with a latched address for the number of bits set in the register 621. A FIFO control circuit 627 prohibits writing in the FIFOs when the comparison circuit 625 has detected that the contents of the two addresses coincide for the number of bits.

When, for example, characters are expanded on 10 lines, if decimal numbers are considered for simplifying the explanation, for example, both addresses "123" and "127" of lines belong to the same group having numbers 120s. That is, by comparing two most significant digits for addresses to be compared, it is possible to determine that the addresses belong to the same string. That is, if data B indicating how many most significant digits must be compared are set in the register 621 for controlling the number of bits to be compared in accordance with the height of characters and the like, it becomes unnecessary to compare all the digits constituting addresses. Since addresses are actually represented by binary numbers, the configuration of the present embodiment wherein a few most significant bits are compared with one another becomes effective.

The value B may be set from the CPU 11, or may be set from the side of the control register 51, as in the FIG. 18 embodiment.

As explained above, according to the present invention, a means for alternately performing using time division a cycle to sequentially rewrite the entire picture surface and a cycle to rewrite lines accessed by the side of a host machine, such as a CPU or the like, is provided. Hence, it is unnecessary to identify whether or not the current data are data to be partially rewritten in accordance with a command or the like, and it becomes also possible to maintain a certain refreshing rate, and to immediately display rewritten data.

Furthermore, if the repetition period of the above-described two cycles and the ratio in time of the two cycles may be variably set, it becomes possible to eliminate an influence due to a difference in operation temperature, the contents of display and the like, and to provide an optimum operation in various cases.

Moreover, in the present embodiment, if the same line is accessed a plurality of times during one sampling period, the address of the line is stored only once. Hence, it becomes possible to efficiently use FIFO memories or the like, and to prevent or decrease the generation of lines which are not displayed though being accessed even if the number of output lines is limited in the subsequent partial rewriting cycle.

Accordingly, it becomes also possible to make a display on the picture surface to follow the movement of a figure or a cursor with a high responsiveness without changing specifications of software and the like of a system using an FLC display, and therefore to perform an excellent display which fully utilizes the features of the FLC. Furthermore, compatibility between the CRT and the FLC as seen from the system can be maintained. Moreover, since the system can be realized with a simple circuit configuration, it becomes possible to perform an inexpensive and high-speed display control.

Third Embodiment

Figure 20A:
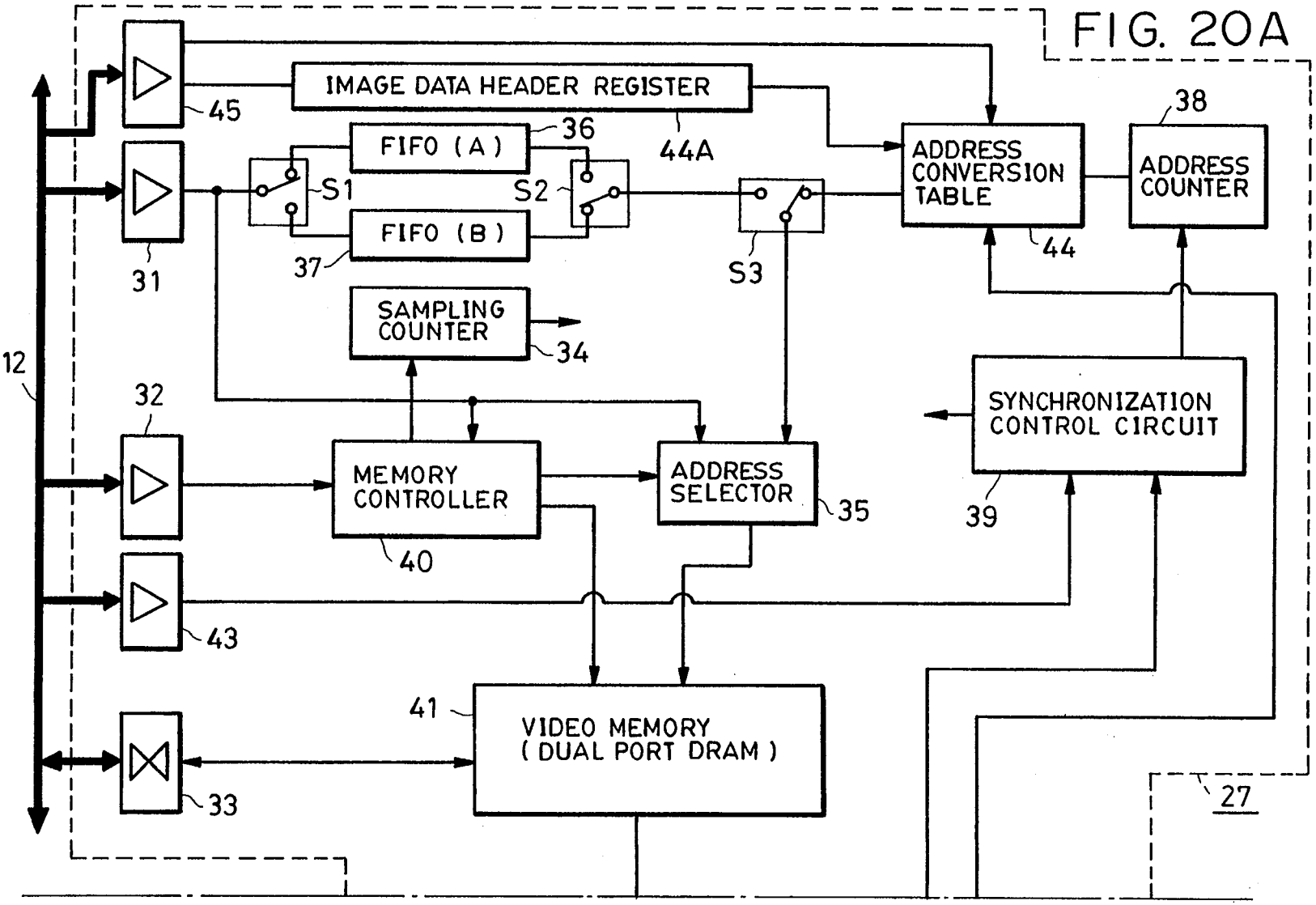
FIG. 20, composed of FIGS. 20A and 20B, is a block diagram showing the configuration of the FLCD interface, serving as the display control device shown in FIG. 1.
Figures 20, 20B:
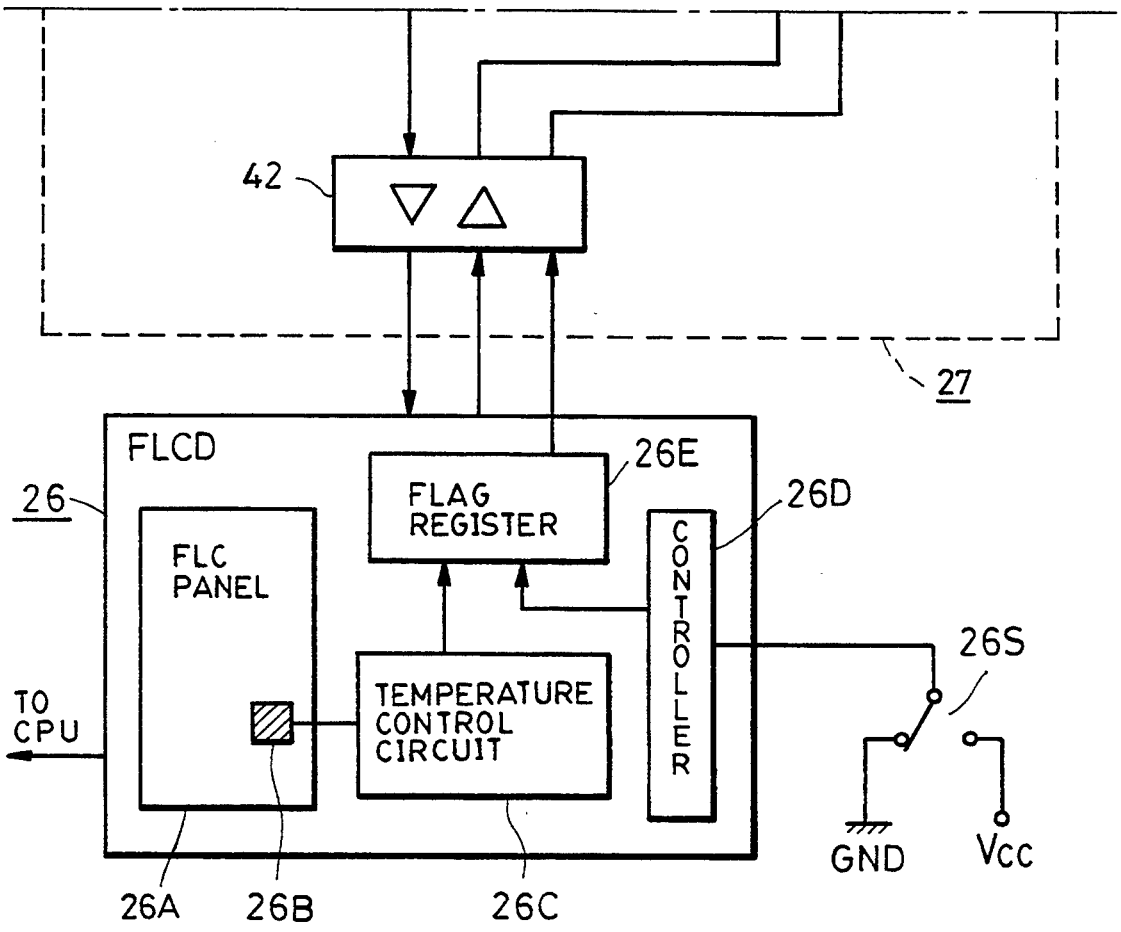

FIG. 20 is a block diagram showing an example of the configuration of the FLCD interface 27, serving as a display control device according to a third embodiment of the present invention. An explanation will now be provided with indicating like circuit configurations and signals as those in FIG. 2 by like numerals.

In FIG. 20, there are shown an address bus driver 31, a control bus driver 32, and data bus drivers 33, 43 and 45, each connected to each bus of the system bus 12. Address data when the CPU 11 addresses a video memory 41 (to be described later) in order to change the contents of display are supplied from the address bus driver 31 to a memory controller 40 and one of two input ports of an address selector 35, and are selectively supplied to and stored in a FIFO(A) memory 36 or a FIFO(B) memory 37. The FIFO(A) memory 36 and the FIFO(B) memory 37 (hereinafter simply termed a "memory A" and a "memory B") are FIFO (first-in first-out) memories wherein data are read in the order of reading. Address data written in these memories 36 and 37 are selectively read by switching a second switch S2.

Address data read from the memory 36 or 37 and address data from an address conversion table 44 (to be described later) for similarly accessing the video memory 41 are selectively input to another input port of the address selector 35 by switching a third switch S3. The address conversion table 44 is referred to according to an address from an address counter 38 which increments its value every time display driving for one line on the display picture surface is performs d, and the contents of the table 44 are output as address data. The address counter 38 increments the address by "1" as described above, and generates address data for performing refreshing driving of the entire picture surface. The generation timing of the address data is controlled by a synchronization control circuit 39. The synchronization control circuit 39 also generates switching control signals for the switches S1, S2 and S3 and a data transfer request signal for a memory controller 40 (to be described later). The control of the generation timing of the above-described signals and the switching timings of the switches S1, S2 and S3 by the synchronization control circuit 39 is performed in accordance with a horizontal synchronizing signal (HSYNC) generated from the side of the FLCD 26 every time display driving for one line of the display picture surface is performed.

A control signal from the CPU 11 is supplied from the control bus driver 32 to the memory controller 40, which controls a sampling counter 34, the address selector 35, and the video memory 41 in accordance with the control signal. That is, the memory controller 40 discriminates address data of the memory 41 accessed by the CPU 11 within a predetermined time period. If a different address is accessed, the data are output to the sampling counter 34, which counts the output data. The count value is supplied to the synchronization control circuit 39, and may be used for determining the ratio between partial rewriting driving and refreshing driving (to be described later).

The memory controller 40 performs arbitration between a memory access request signal from the CPU 11 and a data transfer request signal from the synchronization control circuit 39, switches the output of the address selector 35 in accordance with result of arbitration, selects one of two address data input to the input ports of the address selector 35, and supplies the video memory with the selected data.

The video memory 41, comprising a dual-port DRAM (dynamic random access memory), stores display data, and performs writing and reading of display data via the data bus driver 33. Display data written in the video memory 41 are written and displayed on the FLCD 26 via a driver/receiver 42. The driver/receiver 42 supplies the synchronization control circuit 39 with a synchronizing signal from the FLCD 26.

Data for setting the ratio between the number of lines to be partially rewritten and the number-of lines to be subjected to refreshing driving, and the like are supplied to the synchronization control circuit 39 via the data bus driver 43. Furthermore, header information relating to display image data (to be described later) is set in a header register 44A via the data bus driver 45.

A temperature sensor 26B is provided at an FLC panel 26A of the FLCD Z6 in order to detect the temperature thereof. A temperature control circuit 26C performs the temperature control of the FLC panel 26A which uses a heater or the like according to a temperature detected by the temperature sensor 26B. The temperature control circuit 26C also sets the value of a flag in a flag register 28E referring to a table, which is owned by the flag register 26E and which will be described later with reference to FIG. 5, according to the detected temperature. A controller 26D for controlling the FLCD 26 is provided, for example, on the case of the FLCD 26, and switches the above-described referred table in accordance with a state of a temperature-table switching switch 28S operable by the user. By providing a plurality of tables in accordance with the state of the switch 26S, it is possible to change the temperature threshold for the value of a flag, and, as a result, to reduce the number of flags. It is thereby possible to simplify the configuration of hardware. A variable resistor may be provided in place of the above-described switch, and a plurality of tables may be provided in accordance with the value of the variable resistor.

In the above-described configuration, when the CPU 11 changes a display, an address signal for the video memory 41 corresponding to rewriting of desired data is supplied to the memory controller 40 via the address bus driver 31, where arbitration between a memory access request signal from the CPU 11 and a data trasfer request signal from the synchronization control circuit 39 is performed. If the CPU access side obtains right, the memory controller 40 switches the address selector 35 so as to select the address accessed by the CPU 11 as an address to be provided for the video memory 41. At the same time, the memory controller 40 generates a control signal for the video memory 41, and reading/-writing of data is performed via the data bus driver 33.

At that time, address data to be accessed by the CPU 11 are stored in the FIFO(A) 38 or the FIFO(B) 37, and are utilized when transferring display data (to be described later). As described above, the method of accessing display data from the CPU 11 is entirely the same as in the above-described case for the CRT.

When reading data from the video memory 41 and transferring the read data to the FLCD 26, a data transfer request signal is generated by the synchronization control circuit 39 and is transmitted to the memory controller 40. An address at the side of the address conversion table 44 or the FIFO is selected as the address for the video memory 41 by the address selector 35, and a control signal for data transfer is generated by the memory controller 40. Data of the proper addresses are transferred from the memory cell to the shift register, and are output to the driver 42 by a serial-port control signal.

The synchronization control circuit 39 generates timings for generating cycles to randomly refreshing the entire picture surface in accordance with the embodiment of the present invention according to a horizontal synchronizing signal HSYNC from the FLCD 26, as described above, and partially rewriting cycles to rewrite lines accessed by the CPU 11. In the entire-surface refreshing cycles, lines constituting the display picture surface are randomly subjected to display driving at least once. Lines to be accessed are determined in accordance with the contents of the table selected from the address conversion table 44, as will be described later. In partial rewriting cycles for accessed lines, lines accessed by the CPU 11 within a predetermined time period immediately before the cycle are rewritten.

As described above, in the present embodiment, basically, the operation of refreshing the entire picture surface of the FLCD 26 and the operation of rewriting lines accessed by the CPU 11 in order to change the contents of display are alternately performed using time division. In addition, the repetition period of these operations and the ratio in time between these operations within one period may be set.

First, an explanation will be provided of the basic operation of the present embodiment wherein the refreshing operation and the line-rewriting operation are alternately performed.

An explanation will now be provided of the states of the FIFO(A) 36 and the FIFO(B) 37. If the switch S1 is connected to the side of the FIFO(A) 36, the addresses of lines to be accessed by the CPU 1 are sampled by and stored in the FIFO(A) 36. On the other hand, if the switch S1 is connected to the side of the FIFO(B) 37, the addresses of lines to be accessed by the CPU 11 are stored in the FIFO(B) 37. If the switch S2 is connected to the side of the FIFO(A) 36, the addresses stored in the FIFO(A) 36 are output. If the switch S2 is connected to the side of the FIFO(B) 37, the addresses stored in the FIFO(B) 37 are output.

When one refreshing cycle of the entire picture surface has been completed, and the FLCD 26 has output a vertical synchronizing signal VSYNC or when a carry has been generated in the address counter 38, the address counter 38 is cleared, the line to be output in the next entire-surface refreshing cycle is returned to the line corresponding to the conversion table 44, and lines are sequentially counted up for every horizontal synchronizing signal (HSYNC) provided from the FLCD 26 via the synchronization control circuit 39. If the address of a certain line is accessed by the CPU 11 during this period, the address of the line is stored since the switch S1 is connected to the FIFO(A) 36. Subsequently, when the switch S2 has been connected to the FIFO(A) 36, the stored address is output from the FIFO(A) 36, and an output line is selected. A switching signal for the switch S3 is supplied from the synchronization control circuit 39. The switch S3 is switched to the side of the FIFO(A) and the FIFO(B) for output line addresses in partial rewriting cycles.

At that time, since the switch S1 is connected to the side of the FIFO(B) 37, access addresses are stored in the FIFO(B) 37. In refreshing cycles, the switch S3 is switched to the side of the address conversion table 44, and a refreshing operation is randomly performed according to the contents of the conversion table.

Subsequently, the above-described operation is repeated in the same manner. Two FIFOs are provided in order to consistently and efficiently sample memory-accessed addresses, and at the same time output the sampled addresses. That is, the sampling period of addresses is from starting to output accessed lines in one of the FIFOs to the end of an entire-surface refreshing cycle. After the end of the entire-surface refreshing cycle, a rewriting cycle of accessed lines wherein addresses sampled during the immediately preceding sampling period starts, and at the same time the sampling period for addresses in the other FIFO starts.

As described above, in the basic operation of the present embodiment, the refreshing cycle and the partial rewriting cycle are alternately repeated, and the ratio between these cycles and the like may be changed in accordance with environmental conditions, such as temperature and the like, the kind of data to be displayed, a difference in the display-device material for the FLCD, and the like. That is, by increasing the ratio of the refreshing cycle, the refreshing rate can be increased, providing an excellent display state even if the responsiveness of the FLCD is low, for example, at a low temperature or the like, or an image is displayed. On the contrary, by increasing the ratio of the partial rewriting cycle, the responsiveness in a partial change of display can be increased. Hence, it is possible to deal with a case wherein a high refreshing rate is not needed, for example, at a high temperature, in displaying characters, in displaying the operation, or the like.

Furthermore, in another embodiment of the present invention, in order to prevent or adjust flicker and stripes in an image on the display picture surface to obtain an optimum picture quality, the above-described refreshing cycle is performed in a so-called interlaced mode, which is changed in accordance with image data and the temperature of the FLC panel. An explanation will now be provided of the operation of the refreshing cycle in the interfaced mode according to the embodiment of the present invention.

FIG. 21 is a schematic diagram showing the detail of the address conversion table 44 shown in FIG. 20. As shown in FIG. 21, the conversion table 44 has n tables from table 1 to table n. A table is selected from among these tables in accordance with header information set in the image data header register 44A, and temperature-flag information set in the temperature-flag register 26E. Each table stores address data of lines to be accessed on the display picture surface in accordance with respective addresses 0–N generated by the address counter 38. For example, table 1 stores address data of the 900-th, 821-st, . . . , 8-th and 999-th lines for addresses 0, 1, . . . , N−1 and N, respectively. That is, when the table is used for conversion, lines corresponding to the stored address data are subjected to refreshing driving in the above-described order from address 0 to address N. Each stored pattern of address data, that is, each address generation pattern in the refreshing operation (the line access pattern in the refreshing cycle) has a tendency different from each other corresponding to the above-desribed header information set in accordance with the kind of a display image, such as characters, a line drawing, a natural image (a photograph mode or a fine photograph mode), or the like, and picture quality of the display picture surface, and temperature-flag information set in accordance with the temperature of the FLC panel 26A. For example, if an image to be displayed is a natural image and the temperature of the FLC panel 26A is relatively high, a table having a tendency wherein the interval between lines generated as the address from the address counter 38 is incremented from 0 to N is relatively small is selected. It is thereby possible to perform the operation of refreshing cycles with an appropriate period in accordance with the display image and the temperature of the FLC panel.

The address generation pattern in each table is random, and therefore does not have periodicity in driving for respective lines, contrary to the the operation of refreshing cycles to sequentially drive respective lines on the display picture surface as in the CRT display unit. Hence, the present embodiment has the effect to suppress flicker and stripes in an image.

As will be described later, for example, by operating a knob provided on the case of the FLCD 26, or the like by the user while watching the display picture surface, it is possible to change the above-described header value, that is, the table to be selected from the conversion table 44, and thereby to change the address generation pattern. It is thereby possible to perform an excellent adjustment of flicker and the like of the picture surface.

In the foregoing embodiment, in the conversion table shown in FIG. 21, the number N is made coincide with one cycle of the address counter, that is, the number of lines on the display picture surface, and respective lines are output once in one refreshing cycle. However, it is also possible, for example, to make the number N to be twice the number of lines, and to output respective lines at least once in to refreshing cycles. Furthermore, the contents of each table may be changed. These operations may be performed by data lines input to the address conversion table 44 via the data bus driver 45.

Figure 22:
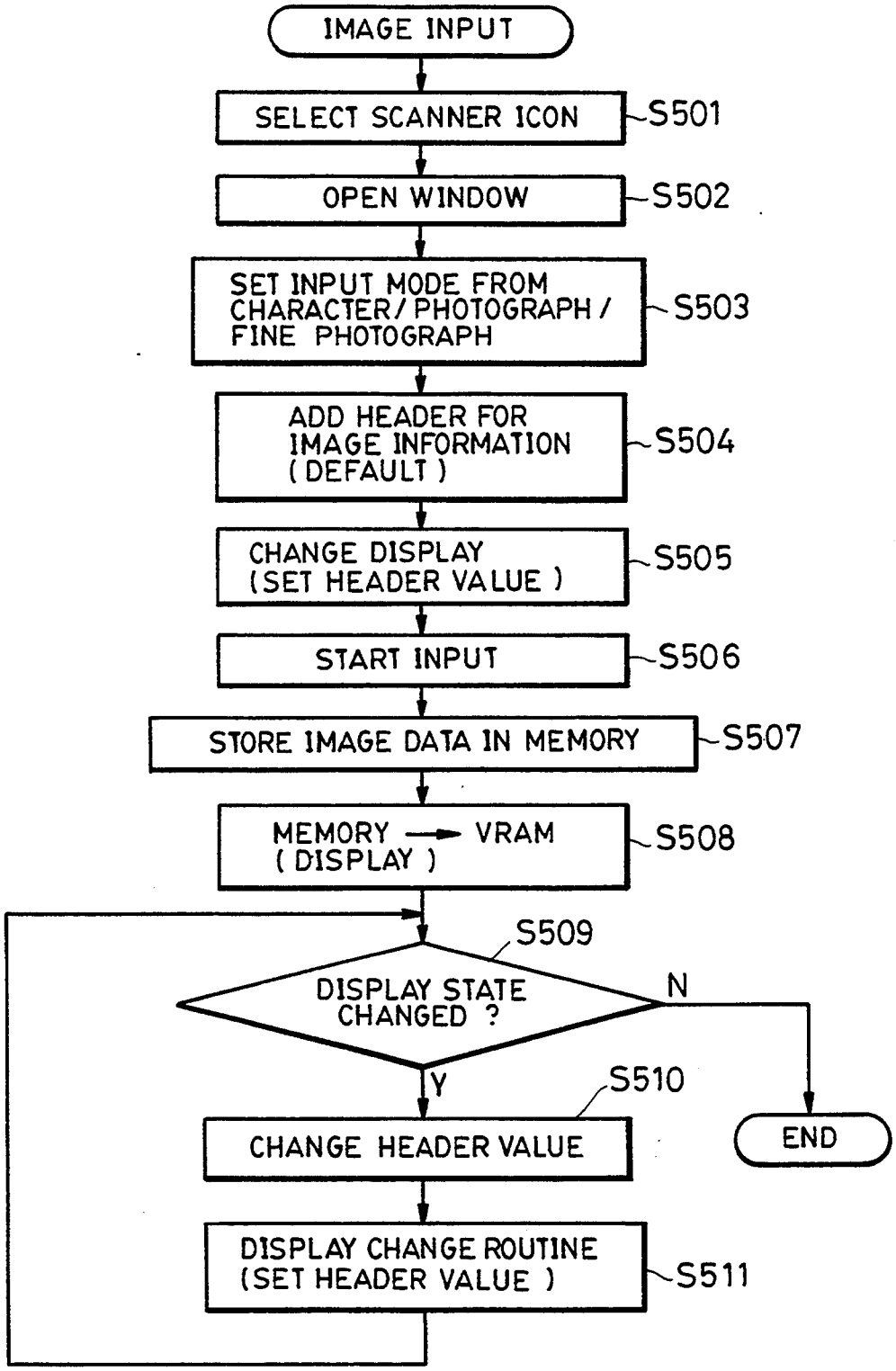
FIGS. 22(A)–22(C) are flowcharts showing control procedures in the information processing system shown in FIG. 1.
FIG. 22(D) is a flowchart showing an operation procedure of the display control device shown in FIG. 20.
Figure 22B:
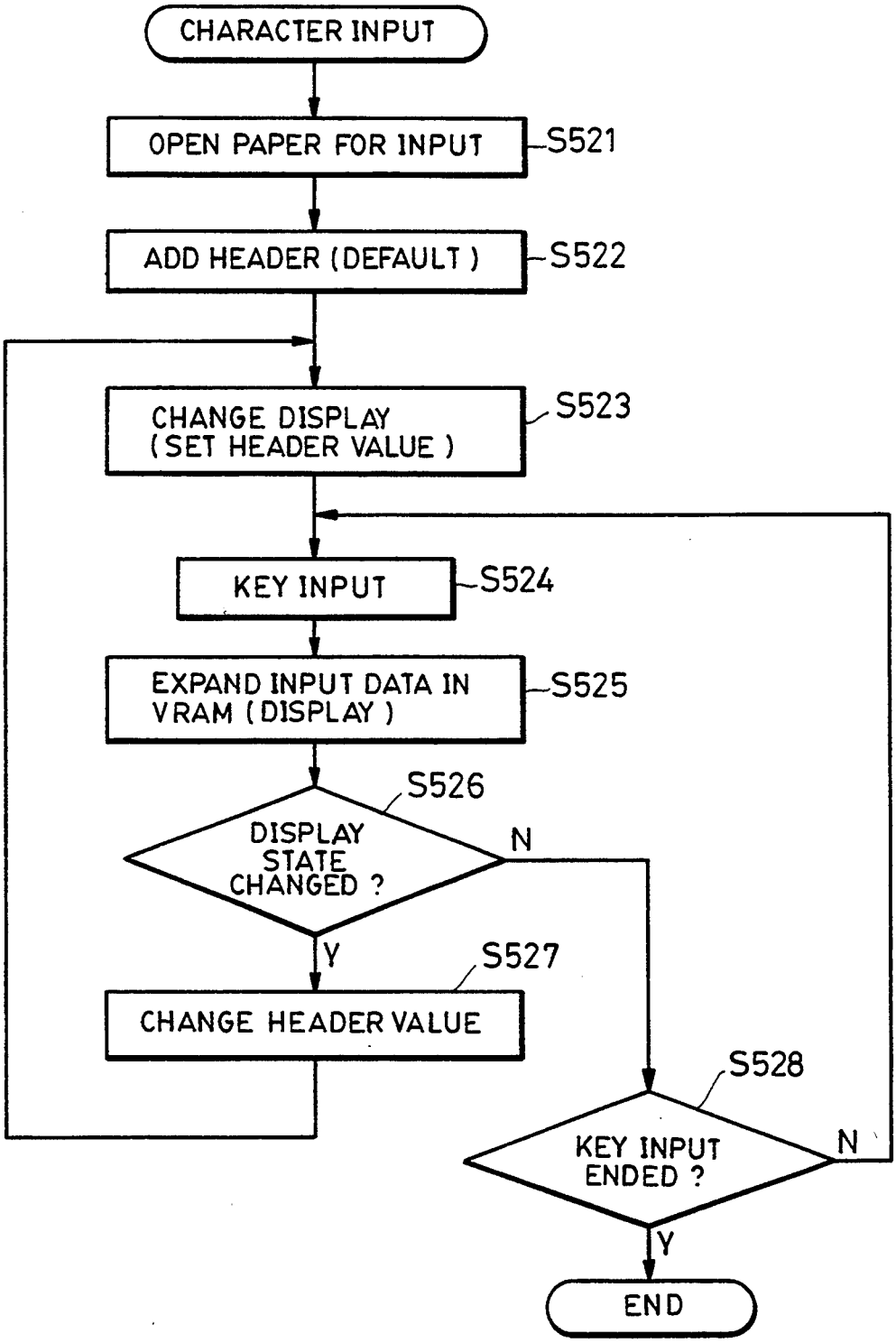
Figure 22C:
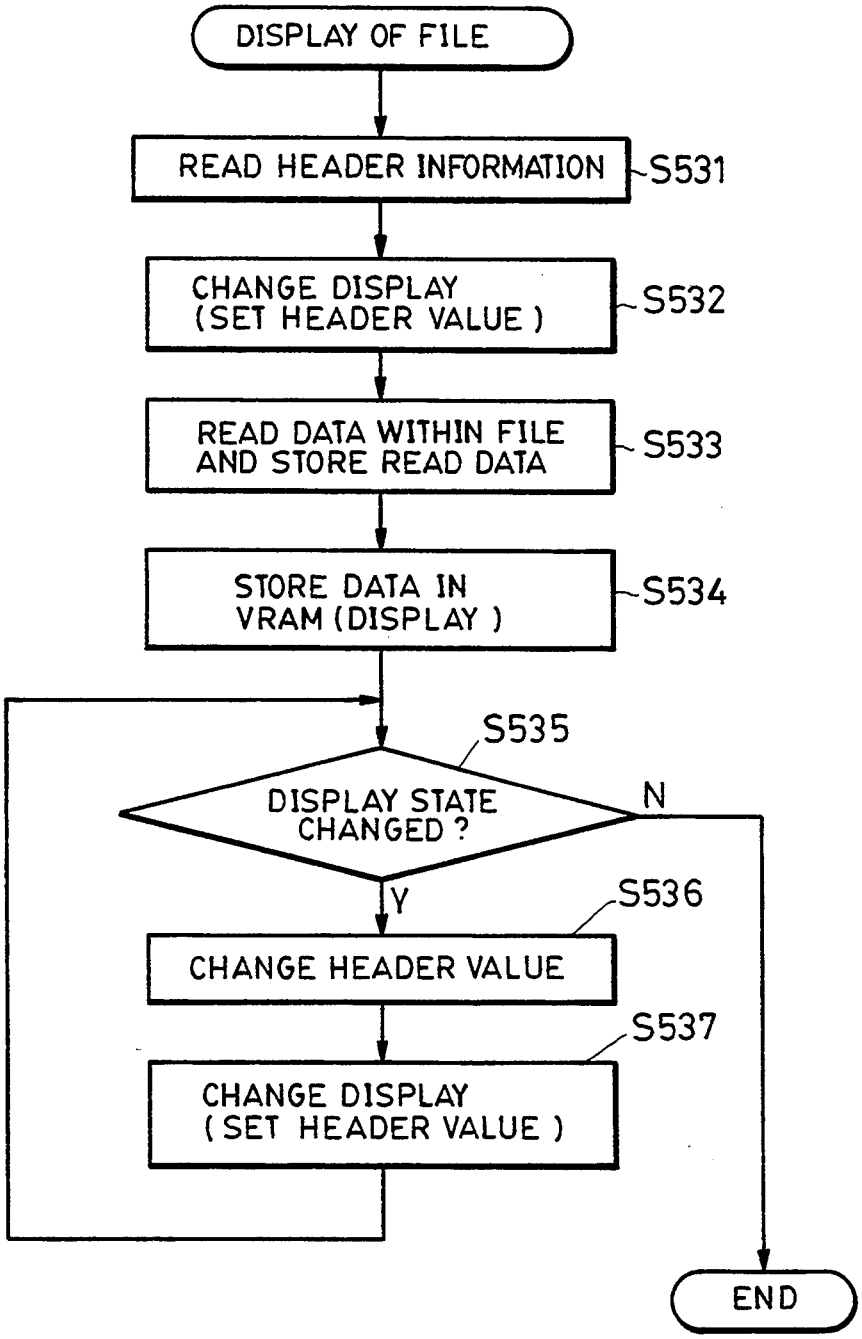
Figure 22D:
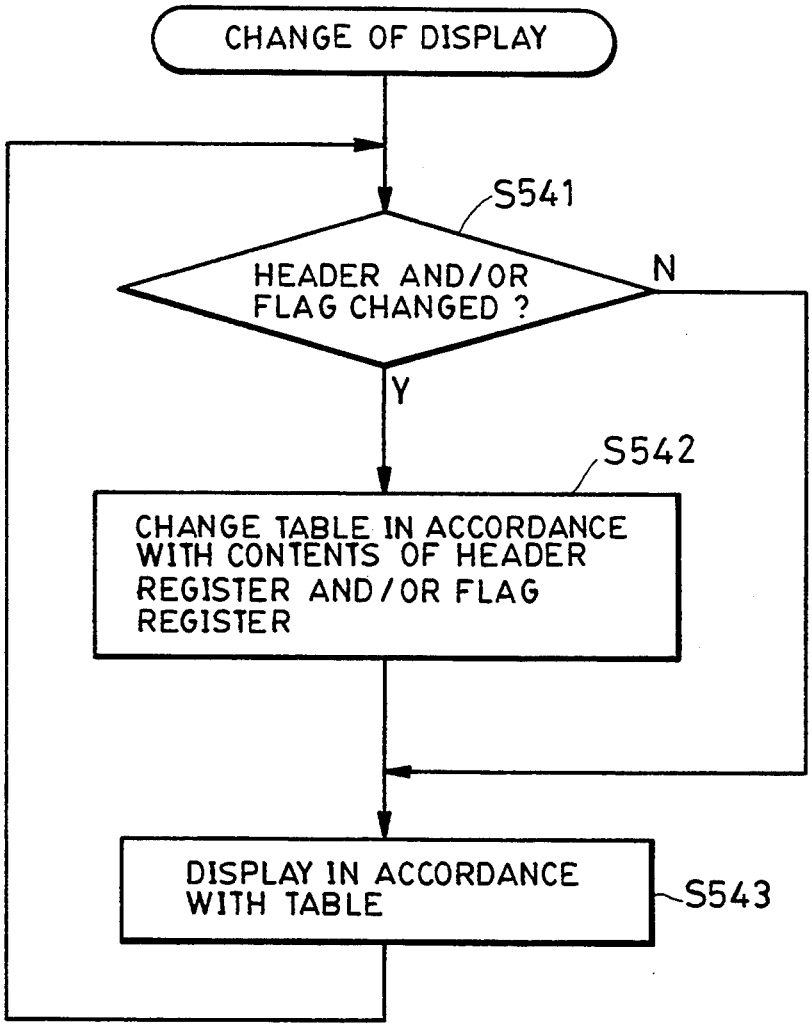

FIGS. 22(A)–22(C) are flowcharts showing control procedures by the CPU 11 accompanying the operation of the user in the information processing system shown in FIG. 1. FIG. 22(D) is a flowchart showing an operation procedure of the FLCD 27 in accordance with the above-described control procedures.

FIG. 22(A) shows a control procedure in an image input mode by the scanner 21B, and when displaying the input data on the FLCD 26. At step S501, a scanner icon on the display picture surface of the FLCD 26 is selected, for example, by the operation of the mouse 24 by the user. At step S502, a window fox displaying an input image on a predetermined portion of the display picture surface is opened. At step S503, the user sets an input mode from among character, photograph and fine photograph modes in accordance with the image input by the scanner 21B. At step S504, header information as described with reference to FIG. 4 is selected in default from among a plurality of predetermined header values, and the selected information is added. At the same time, at step S505, the header information is set in an image data header register 44A shown in FIG. 2.

Subsequently, at step S506, the input operation by the scanner 21B is started. At step S507, input image data are first stored in the main memory 13 in order to adjust resolution between the scanner 21B and the FLCD 26. Subsequently, at step S508, the image data are expanded in the video memory 41, and are displayed.

Subsequently, at step S509, it is determined whether or not the user has changed the display state by operating a knob provided on the display picture surface in order to change the display picture quality. If the result of determination is affirmative, at step S510, another header value is selected from among the above-described plurality of header values in accordance with the change. At step S511, the header information is set in the header register 44A. If the result of determination at step S509 is negative, the processing is terminated.

FIG. 22(B) shows a control procedure in a character input mode corresponding to a word processor. If the present processing is started, for example, by a predetermined key operation on the keyboard 23, paper for input is displayed on a predetermined portion of the display picture surface. At step S522, a predetermined header value is selected in default from among the above-described plurality of header values, and the selected header value is added to a predetermined area in the memory. At step S523, the header value is set in the header register 44A.

Subsequently, at step S524, key input is performed. At step S525, key input data are expanded in the video memory 41, and are displayed.

Subsequently, at step S526, it is determined whether or not the user has changed the display state, in the same manner as in the control procedure shown in FIG. 22(A). If the result of determination is affirmative, the header value is changed at step S527. The process then returns to step S523, where the header value is set in the register 44A in order to change the display. If the result of determination at step S526 is negative, it is determined whether or not the key input has ended at step S528. If the result of determination is affirmative, the present processing is terminated. If the result of determination is negative, the process returns to step S524. FIG. 22(C) shows the control procedure of a file display mode for displaying a file stored in the hard disk 18 or the floppy disk 19.

When the present processing has been started, header information for the file is read at step S531. At step S532, header information added to the file is set in the header register 44A. Subsequently, at step S533, data within the file are stored in the memory 13 in order to perform the above-described adjustment of resolution and the like. At step S534, these data are expanded in the video memory 41, and are displayed. At steps S535–S537, the same processing as the processing at steps S509–S511 shown in FIG. 22(A) is performed.

FIG. 22(D) shows the operation of the FLCD interface 27 corresponding to respective control procedures shown in FIGS. 22(A)–22(C).

That is, if there has been any change in at least one of the contents of the image data header register 44A and the flag register 26E at step S541, at step S542, the table to be used in conversion by the address conversion table 44 is changed in accordance with the above-described change. At step S543, the above-described refreshing operation is performed in accordance with the changed table.

As explained above, according to the foregoing embodiment of the present invention, the interlaced mode in refreshing driving is changed in accordance with the kind of a display image, the picture quality of the display picture surface, and the kind of an apparatus which constitutes the information processing system and supplies display data, and the like.

Although, in the foregoing embodiment, the table is changed in accordance with the contents of the header register 44A and the contents of the temperature flag register 26E, the table may be changed in accordance with either one of the above-described contents.

Although, in the foregoing embodiment, the change of the table in the address conversion table 44 is independently performed at an appropriate time in accordance with a change in the header, the temperature flag and the like, the synchronization control circuit may, for example, control the timing of a change in the address conversion table 44 so that the table is changed every time a signal HSYNC is generated.

Furthermore, the same refreshing driving as in the foregoing embodiment may be performed by generating a random number in place of the address generation using the address conversion table, first accessing the line corresponding to the random number, and setting a flag for a line wherein access has been completed. That is, by not accessing lines wherein flags have already been set, and accessing only lines wherein flags are not set, the refreshing cycle is completed when flags have been set for all the lines.

As is apparent from the foregoing explanation, according to the present invention, almost irregular addresses are generated, for example, from an address conversion means, such as ant address conversion table or the like. Hence, if these addresses correspond, for example, to scanning lines comprising a plurality of display elements on the display picture surface, these lines are almost irregularly accessed, and the display states of the lines are updated.

Since the above-described address conversion means comprises a plurality of conversion means which are changed in accordance with set information and temperature information of the display picture surface, addresses may be generated in a different manner according to the above-described set information and the like.

As a result, the access for updating display for each line on the display picture surface does not have periodicity. Hence, it is possible to effectively prevent or adjust flicker on the display picture surface.

Furthermore, since the manner of accessing the above-described lines may be different in accordance with set information corresponding to display data and the like, and the temperature of the FLC panel, it is possible to perform display having an appropriate picture quality in accordance with the set information, if a predetermined tendency is provided for irregularity in each table in the conversion table.

What is claimed is:

1. A display control device, for controlling a display on a picture surface of a display unit including plural picture elements arranged in lines and being capable of partially changing display states of the picture surface, said display control device comprising:

entire updating means for updating the display states of the entire picture surface of said display unit;

partial updating means for updating a portion of the picture surface when at least one of the display states has changed;

selective updating means for determining a number of lines to be updated, and for selecting updating by said entire updating means or said partial updating means; and restriction means for restricting start of operation of said partial updating means or said entire updating means in accordance with whether the number of lines to be updated exceeds a predetermined number, said predetermined number being less than a total number of lines in said display unit.

2. A display control device according to claim 1, further comprising setting means for setting a time period for updating the portion when the one display state has been changed by said partial updating means.

3. A display control device according to claim 1, wherein said picture surface comprises a storage-type liquid crystal display panel.

4. A display control device according to claim 1, wherein said picture surface comprises a ferroelectric liquid crystal display.

5. A display control device according to claim 1, wherein after updating of said number of lines is completed, said selective updating means decides the number of lines to be updated next.

6. A display control device according to claim 1, wherein said selective updating means decides the number of lines to be updated in accordance with the data to be displayed.

7. A display control device according to claim 1, wherein said selective updating means decides the number of lines to be updated in accordance with the temperature of the display unit.

8. A display control device according to claim 1, further comprising a table storing data representing the order in which updating is to be performed by said entire updating means, and wherein said entire updating means performs updating on the basis of said table.

9. A display control device according to claim 8, further comprising a plurality of said tables, each of said tables storing different data representing different orders in which updating is to be performed, wherein said selective updating means selects one of the tables and said entire updating means performs updating on the basis of the selected table.

10. A display control device comprising:

display means having a picture surface including plural picture elements arranged in lines for partially changing display states of the picture surface;

entire updating means for updating the display states of the entire picture surface of said display means;

partial updating means for updating a portion of the picture surface when at least one of the display states has changed; and selective updating means for determining a number of lines to be updated, and for selecting updating by said entire updating means or said partial updating means; and restriction means for restricting start of operation of said partial updating means or said entire updating means in accordance with whether the number of lines to be updated exceeds a predetermined number, said predetermined number being less than a total number of lines in said display unit.

11. A display control device according to claim 10, wherein said display means comprises a storage-type liquid crystal display panel.

12. A display control device according to claim 10, further comprising setting means for setting a time period for updating the portion when the one display state has changed by said partial updating means.

13. A display control device according to claim 10, wherein said display means comprises a ferroelectric liquid crystal display.

14. A display control device according to claim 10, wherein after the updating of said number of lines is completed, said selective updating means decides the number of lines to be updated next.

15. A display control device according to claim 10, wherein said selective updating means decides the number of lines to be updated in accordance with the data to be displayed.

16. A display control device according to claim 10, wherein said selective updating means decides the number of lines to be updated in accordance with the temperature of the display unit.

17. A display control device according to claim 10, further comprising a table storing data representing the order in which updating is to be performed by said entire updating means, and wherein said entire updating means performs updating on the basis of said table.

18. A display control device according to claim 17, further comprising a plurality of said tables, each of said tables storing data representing different orders in which updating is to be performed, wherein one of the tables is selected and wherein said entire updating means performs updating on the basis of the selected table.

* * * * *

UNITED STATES PATENT AND TRADEMARK OFFICE

CERTIFICATE OF CORRECTION

PATENT NO. : 5,436,636

DATED : July 25, 1995

INVENTOR : HIROSHI NONOSHITA, ET AL.

It is certified that errors appear in the above-identified patent and that said Letters Patent is hereby corrected as shown below:

Title page, item,

[57] ABSTRACT

Last line, "line" should read --lines--.

COLUMN 4

Line 55, "to, be" should read --to be--.

COLUMN 15

Line 61, "thee" should read --the--.

COLUMN 20

Line 3, "$T_h2$," should read --$T_H2$,--.

COLUMN 22

Line 64, "it" should read --to--.

COLUMN 25

Line 45, "performs d," should read --performed,--.

COLUMN 26

Line 32, "FLCD Z6" should read --FLCD 26--.

COLUMN 27

Line 20, "refreshing" should read --refresh--.

UNITED STATES PATENT AND TRADEMARK OFFICE

CERTIFICATE OF CORRECTION

PATENT NO. : 5,436,636

DATED : July 25, 1995

INVENTOR : HIROSHI NONOSHITA, ET AL.

It is certified that errors appear in the above-identified patent and that said Letters Patent is hereby corrected as shown below:

COLUMN 29

Line 41, "coincide" should read --coincident--; and

Line 62, "fox" should read --for--.

COLUMN 31

Line 36, "ant" should read --an--.

Signed and Sealed this

Twenty-third Day of September, 1997

*Attest:*

Bruce Lehman

BRUCE LEHMAN

*Attesting Officer*

*Commissioner of Patents and Trademarks*